US008701833B2

(12) United States Patent
Marquardt et al.

(10) Patent No.: US 8,701,833 B2
(45) Date of Patent: Apr. 22, 2014

(54) DISTANCE LIMITING SELF-RETRACTABLE LIFELINE

(75) Inventors: Edward R. Marquardt, Silverdale, WA (US); Evan M. Choltco-Devlin, Seattle, WA (US)

(73) Assignee: GF Protection Inc., Kent, WA (US)

( * ) Notice: Subject to any disclaimer, the term of this patent is extended or adjusted under 35 U.S.C. 154(b) by 1606 days.

(21) Appl. No.: 12/148,883

(22) Filed: Apr. 22, 2008

(65) Prior Publication Data

US 2009/0260922 A1 Oct. 22, 2009

(51) Int. Cl.
*A62B 1/08* (2006.01)

(52) U.S. Cl.
USPC ..... 182/231; 182/236; 182/232

(58) Field of Classification Search
USPC ..... 182/231, 236, 232, 237
See application file for complete search history.

(56) References Cited

U.S. PATENT DOCUMENTS

| | | | | | |
|---|---|---|---|---|---|
| 775,704 | A | * | 11/1904 | Howe | 182/240 |
| 3,602,453 | A | * | 8/1971 | Holmes | 242/309 |
| 4,489,919 | A | * | 12/1984 | Ostrobrod | 254/346 |
| 4,538,702 | A | | 9/1985 | Wolner | |
| 4,589,523 | A | | 5/1986 | Olson et al. | |
| 4,621,589 | A | * | 11/1986 | Thinnes | 119/770 |
| 4,877,110 | A | | 10/1989 | Wolner | |
| 5,186,289 | A | | 2/1993 | Wolner | |
| 5,287,950 | A | | 2/1994 | Feathers et al. | |
| 6,431,525 | B1 | | 8/2002 | Roll | |
| 6,446,936 | B1 | | 9/2002 | Ostrobrod | |
| 6,523,771 | B2 | | 2/2003 | Sumiyashiki | |
| 7,281,620 | B2 | | 10/2007 | Wolner et al. | |
| 2005/0051659 | A1 | | 3/2005 | Wolner | |
| 2007/0151805 | A1 | | 7/2007 | Betcher et al. | |
| 2008/0035423 | A1 | | 2/2008 | Meillet | |
| 2008/0041661 | A1 | | 2/2008 | Meillet | |
| 2009/0084883 | A1 | | 4/2009 | Casebolt et al. | |

FOREIGN PATENT DOCUMENTS

DE 2745563 A * 4/1979

* cited by examiner

*Primary Examiner* — Alvin Chin Shue
(74) *Attorney, Agent, or Firm* — Miller Nash LLP; Kathleen T. Petrich

(57) ABSTRACT

A self-retractable lifeline ("SRL") having the combination of an active fall arrest braking system and a passive restraint distance limiting mechanism that allows a user to pretension and preset the distance that its cable is capable of paying out. The SRL's cable limiting mechanism includes a pretension assembly, which may include a pair of aligned plates and an actuator that temporarily mobilizes an arbor when the lever is opened. The arbor is affixed to the SRL housing and to an interior of a power spring that rewinds the cable back into the housing when the cable is paid out. The other end of the arbor is in a mechanical relationship to one of the aligned plates that prohibits rotational movement of the arbor when the aligned plates are engaged but allows rotational movement of the arbor when the aligned plates are temporarily disengaged.

25 Claims, 20 Drawing Sheets

DISTANCE LIMITING SELF-RETRACTABLE LIFELINE

TECHNICAL FIELD

The present invention relates generally to self retracting lifelines or SRLs. In particular, the present invention generally relates to an SRL that can be pretensioned in order to limit cable payout.

BACKGROUND OF THE INVENTION

Self Retracting Lifelines (SRLs) have been well known in the fall arrest industry. Workers use SRLs as a safety means to arrest a dangerous or potentially life-threatening fall, particularly in high rise construction and maintenance. A worker or other user typically wears a safety harness with an aperture (e.g., a D-ring) that is connected to a hook at one end of the SRL. The other end of the SRL is secured to a permanent structural member of the building or work site. The SRL includes a housing that contains a cable that is wrapped around a central reel body. The cable, being connected to the hook on one end, can "pay out" through an aperture of the housing and retract back on itself through the use of a power spring. SRLs utilize an active braking system positioned within the housing that can quickly stop the cable from paying out when a particular velocity or G-force is detected. Most SRL braking systems have incorporated some form of ratchet/pawl mechanism in which a pawl engages a tooth of a ratchet when the braking system senses sufficient G force or revolutions denoting quick cable pay out. A typical ratchet/pawl braking system is illustrated in U.S. Pat. No. 4,589,523 to Olson et al.

Fall arrest equipment is inherently "active," meaning that it stops a user in the act of a fall. Fall restraint is "passive," such as a rope or barrier to keep a user from falling in the first place. OSHA mandates fall protection for workers in such applications where the work surface is over 6 feet off the ground. This can include either type of system. However, most high rise applications use fall arrest equipment and, particularly, SRLs.

Most SRLs are of industry standard sizes, e.g., 65', 50', or shorter. Because of the predefined length of the cable, various sized products must be used in accordance with the particular work environment and the distance a worker needs to complete a task. For example, a 65' retractable may not be used on a job site in which the safe fall range exceeds that distance. However, it is expensive and not always practical to have varying size SRLs on each job site or in storage for use in large contractor warehouses.

Further, there is no known attempt at creating an active SRL that can be adapted for variable fall restraint (passive) protection. With little doubt, it is much safer for a user to avoid falling altogether—even if the worker falls with appropriate fall arrest equipment. This is because a falling worker with active fall restraint equipment will stop with a sudden jerk and the fall and sudden stop can cause panic, discomfort, and possible injury. However, OSHA guidelines will not allow a purely passive restraint system to be utilized where active fall arrest is required. There is no known commercial solution to combine an active fall arrest SRL with a passive restraint feature into one device in which the cable payout distance cannot physically go past a particular job-site requirement (e.g., the falling point off a ledge or roof edge of a building), as well as the possibility of using a single SRL (e.g., 65' SRL) in a multitude of work environments.

SUMMARY OF THE INVENTION

The present invention is directed to an active self-retracting lifeline (SRL) having an active braking system that also includes a passive cable pay out limiting feature that functions independently of the active braking system. In the present invention, the SRL is adapted to include a pretension assembly that allows a user to pretension the cable take-up a set amount prior to use. For example, a 65' SRL could be pretensioned to effectively limit cable payout to 30' for a particular application. Once the SRL is pretensioned to the desired length, the user can only move about the distance that the user intended (in the example, 30') as there is no additional cable to allow movement past this distance. In this way, the worker virtually avoids the need for the active braking system of the SRL as the user is unlikely to find himself or herself in a fall situation.

The SRL of the present invention include a cable length that is wrapped around a central reel body. A power spring that retracts the cable back when paid out can pay out or take in before binding in on itself. This can be measured in the revolutions that the spring can make or "turns." The user can limit the number of turns that the spring can make by winding up the power spring, in which a portion of the spring is rendered immobile by fixing it to an arbor, which is ordinarily directly or indirectly fixed to an interior portion of the housing and the other portion of the spring is connected to the reel body that rotates about an arbor. The amount of turns the power spring is wound without any cable being paid out is called "pretension."

To artificially pretension the power spring, the pretension assembly functions to temporarily mobilize the arbor so that the arbor can rotate when a force is applied to it. The rotating arbor pretensions the power spring a number of desired turns.

According to a first embodiment, the pretension assembly may include an actuator and a pair of engaged aligned plates that are capable of being disengaged when a force is applied to at least one of the plates. One of the plates is directly or indirectly attached to the SRL housing. A portion of the arbor is prohibited from rotational movement relative to the other plate when the plates are engaged. When the actuator is activated, it temporarily mobilizes the arbor because the aligned plates are separated through tension force, which may be a tension spring. According to one aspect of the invention, the aligned plates are a lock ring and a mating lock ring plate. According to another aspect of the invention, the lock ring may include a plurality of sides or faces, such as in the shape of a hexagon, that mate with a similar shaped lock ring plate. The number of faces may vary, but the number can be used to determine the resolution of the distance limiting function.

According to one aspect of the invention, one of the aligned plates is to the housing through a perch or perch ring.

According to another embodiment, the pretension assembly may include a pair of aligned plates in which the plates are connected through a plurality of pins and corresponding apertures or plates with corresponding mating splines/teeth that prohibit rotational movement of the arbor until the plates are disengaged. One of the plates is secured to the housing and may itself be a perch or perch ring.

According to yet another aspect of the invention, the actuator may be a quick release cammed actuation lever having a handle. The cammed actuation lever and handle allow the user to immediately see if the actuation lever is in the open position or not. Further, the handle makes it easier to determine the number of turns that are to be made in the field in order to limit the cable pay out to a set distance.

In use, the actuator is activated and applies a force on the tensioner to disengage the pair of aligned plates. The arbor, which is connected to one of the aligned plates, is then temporarily mobilized and may be rotated to pretension (or take up) the power spring, which necessarily limits the cable pay out by the number of turns the power spring is pretensioned. Once the user sets a desired cable payout length, the actuator is deactivated and the aligned plates are again engaged in a mating relationship and the arbor is once again rendered immobile relative and can no longer rotate.

Another embodiment of the invention includes an overtensioning assembly. According to one aspect of this overtensioning assembly, a pair of fittings on the opposite end of the arbor in order to prevent the power spring from being overtensioned through human error. One fitting, such as a spin stop fitting with a shape to correspond to a threaded nut head, may be affixed to the other end of the SRL housing. A corresponding spinnable fitting, such as threaded nut head, may be mounted at the end of the arbor. The arbor may rotationally move within the spin stop fitting via the threaded head nut which can laterally slide within the spin stop fitting until it hits an abutment, such as an end plate, indicating that the power spring should not be further tensioned.

These and other advantages will become more apparent upon review of the Drawings, the Detailed Description of the Invention, and the Claims.

BRIEF DESCRIPTION OF THE DRAWINGS

Like reference numerals are used to designate like parts throughout the several views of the drawings, wherein.

DETAILED DESCRIPTION OF THE INVENTION

The present invention is directed to a self-retracting lifeline (SRL) 10 in which the cable payout can be limited to a desired length in the field to allow maximum usage from a single device.

Figure 1:
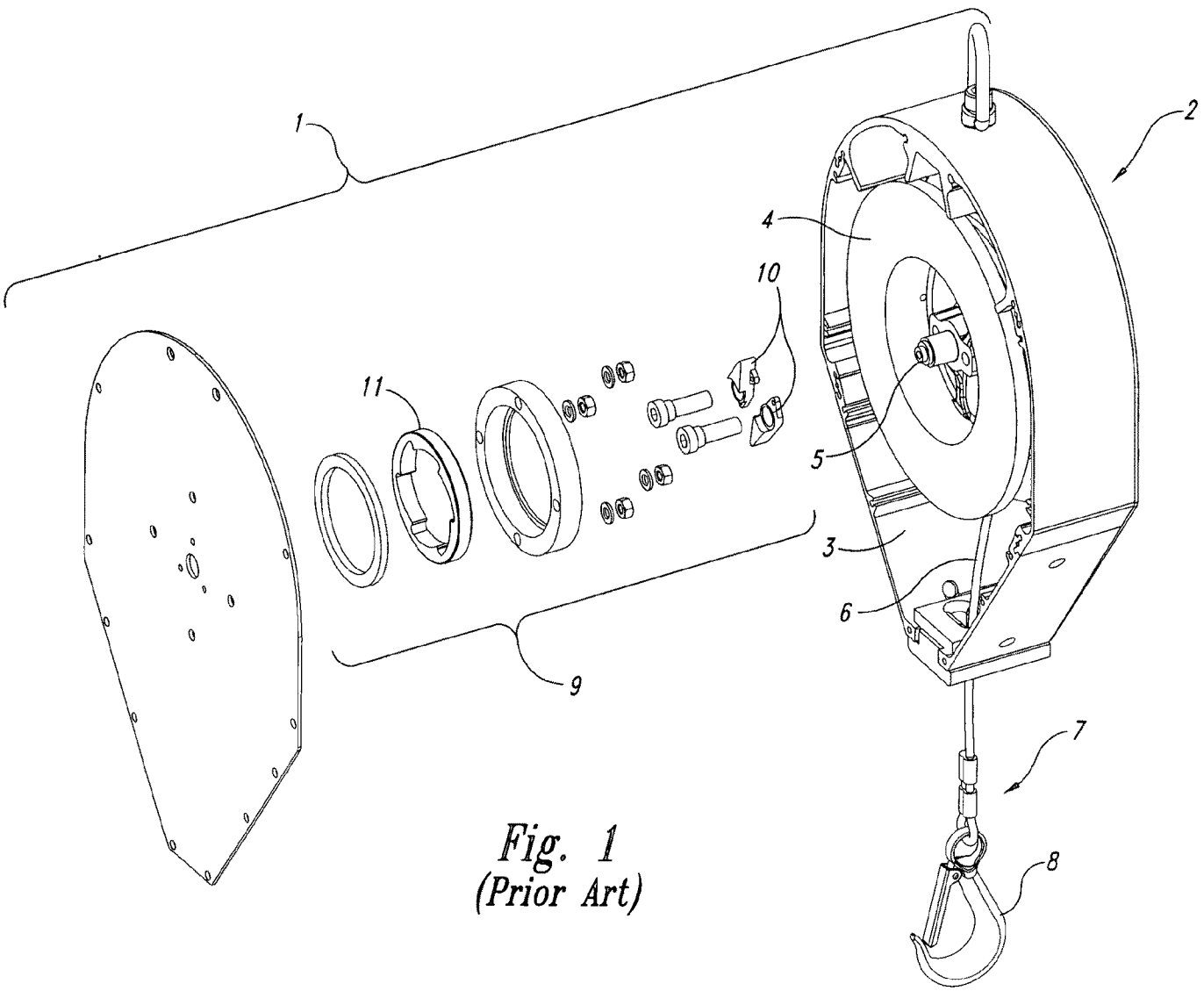
Fig. 1 (Prior Art)
FIG. 1 is an exploded perspective view of a typical self-retracting lifeline ("SRL") shown with an active fall arrest braking mechanism and a cable and connector (hook) of the Prior Art.

Referring to FIG. 1, a typical SRL 1 of the prior art contains a housing 2 with an interior 3 with a central reel body 4 that rotates about an arbor 5. A cable 6 that is wound about the central reel body 4 is able to extend outside the house through an aperture. The central reel body 4's movement is limited to rotational movement within the housing 2. The cable 6 is retractable about the central reel body 4 so that cable may be played out or limited depending on a force acting on an external end 7 of the cable. At the external end of the cable is a connector 8, such as a hook, that would be attached to a wearer's safety harness (not shown).

The SRL of the prior art contains an active fall arrest braking system 9, such as the kind shown in afore-mentioned U.S. Pat. No. 4,589,523, that may include a set of pawls 10 and ratcheted ring 11 in which the pawls engage teeth 12 of the ratchet ring when a sufficient force is quickly applied to the end of the cable (such as a worker in a state of fall).

Figure 2:
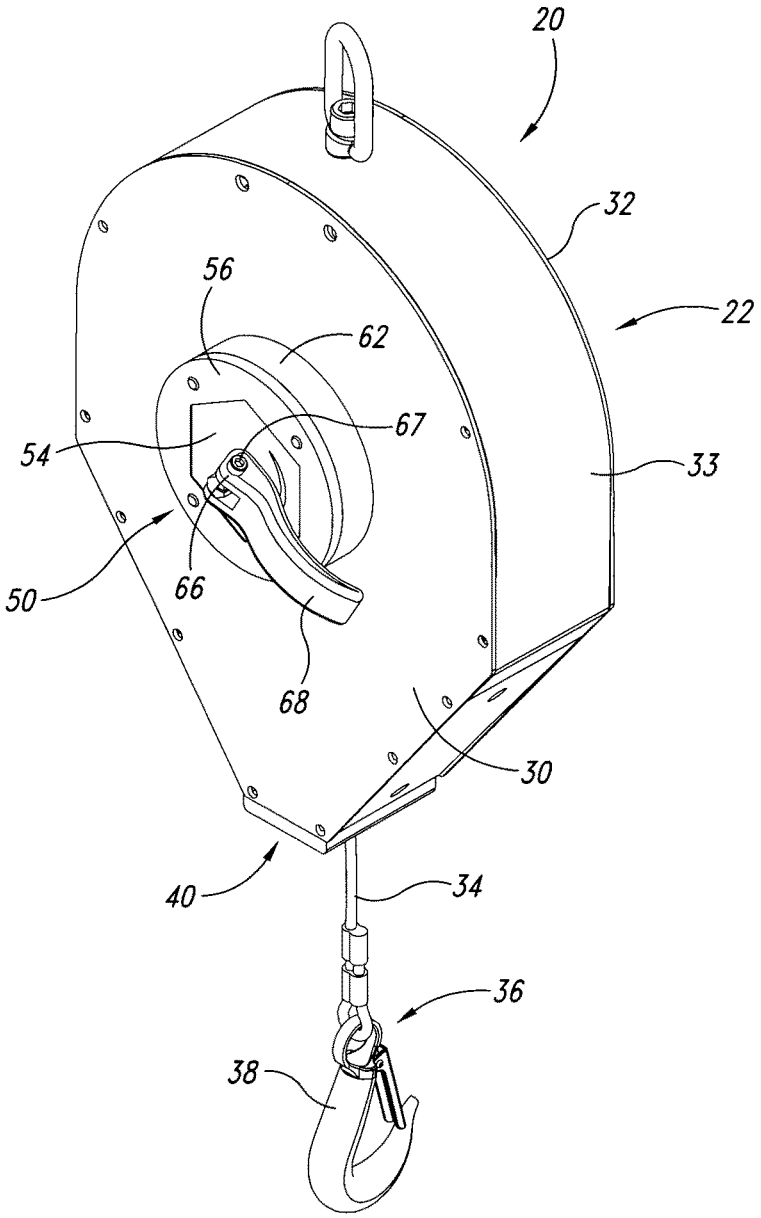
FIG. 2 is a perspective view of a first embodiment of the present invention showing a SRL and the external components to passively limit cable payout distance.
Figure 3:
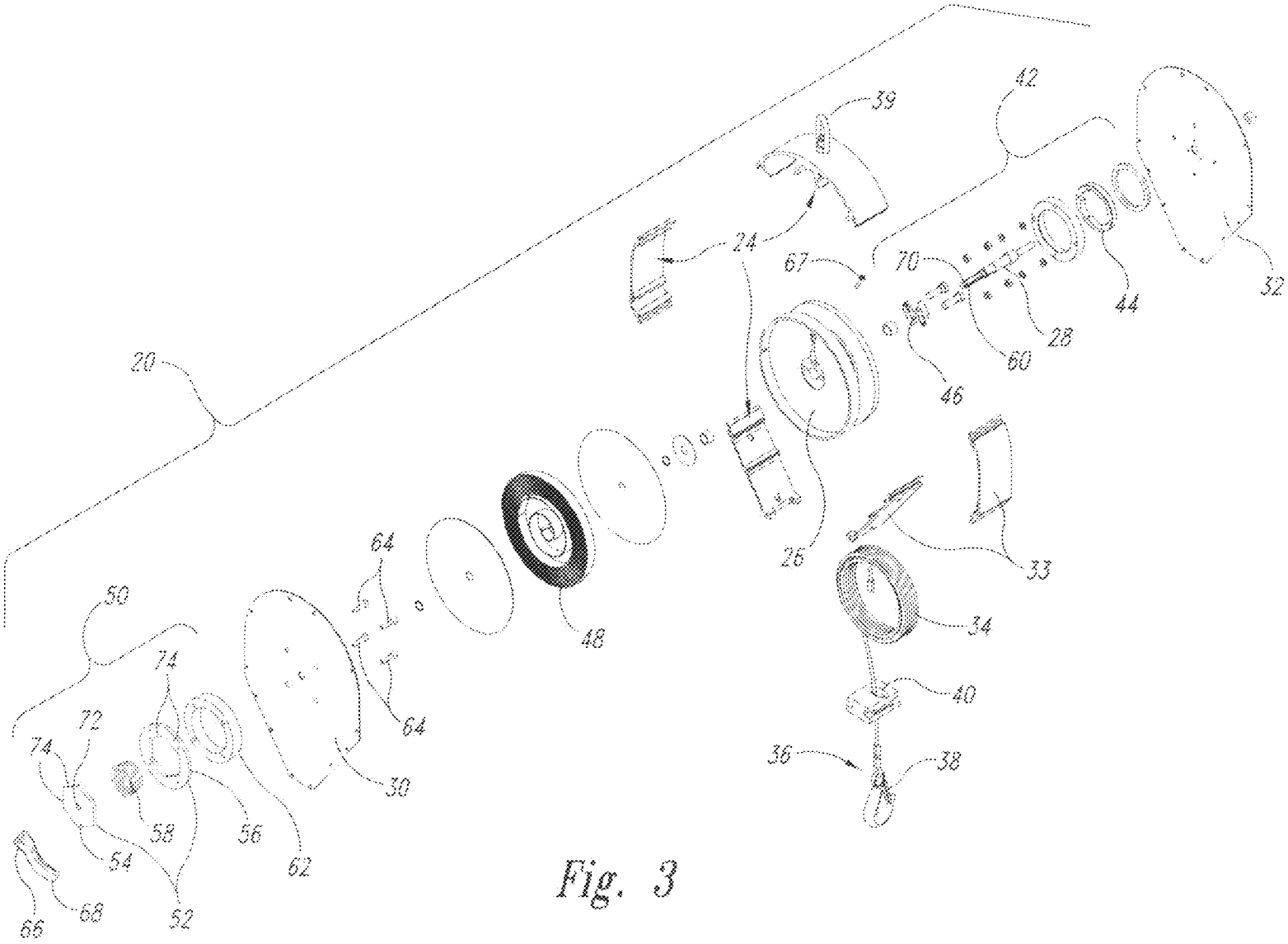
FIG. 3 is an exploded perspective view of the SRL of the first embodiment.
Figure 4:
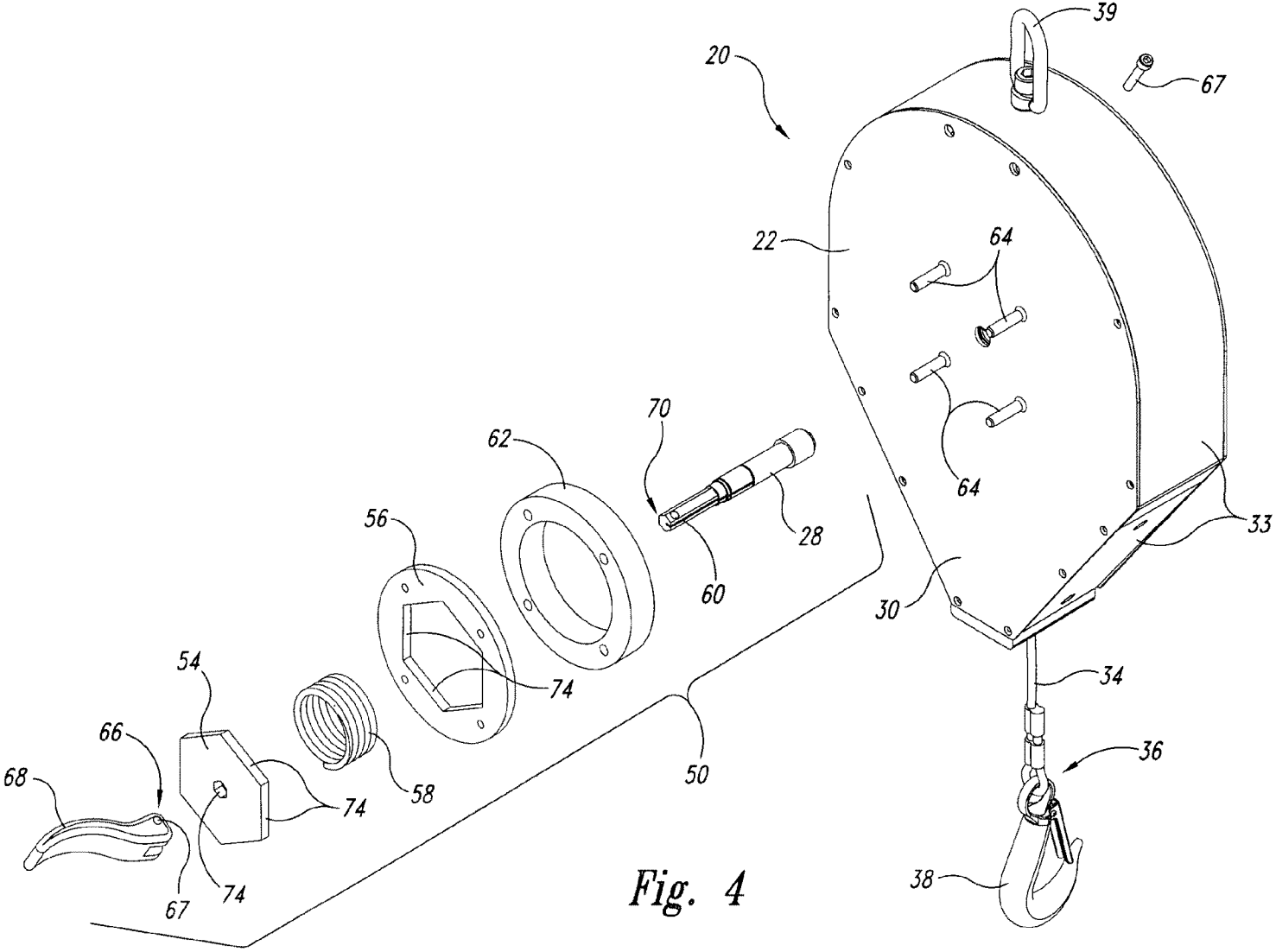
FIG. 4 is an exploded perspective view of the pretension assembly of the first embodiment illustrating an arbor, an actuator, a tensioner, and a pair of aligned plates, all in relation to an otherwise assembled SRL.
Figure 5:
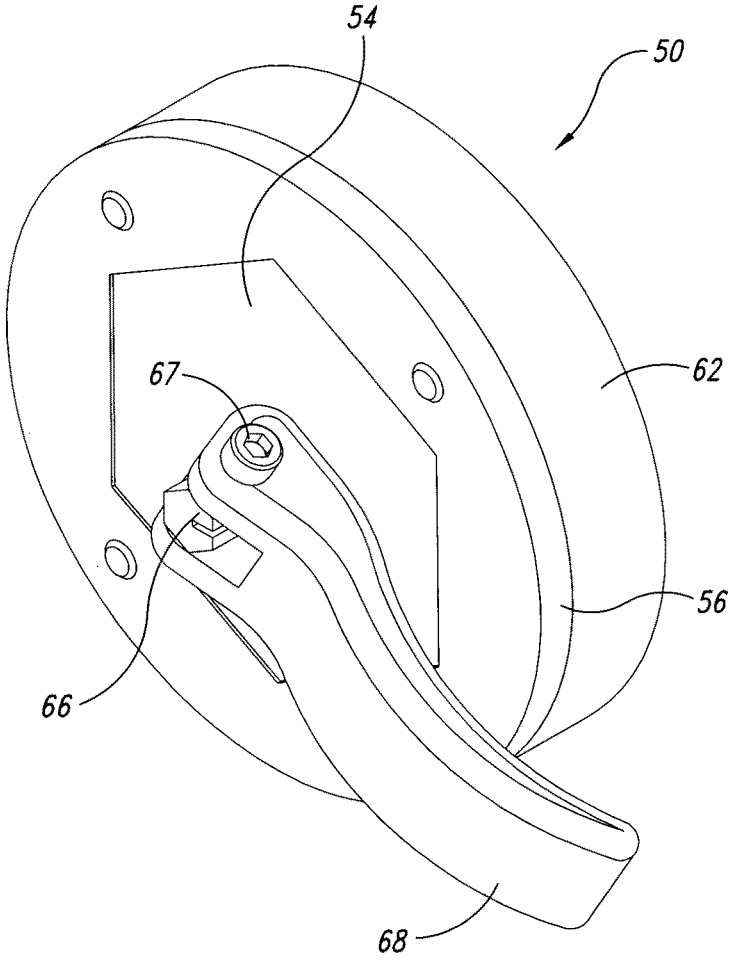
FIG. 5 is an enlarged perspective view of the assembled external components of the pretension assembly.
Figure 6:
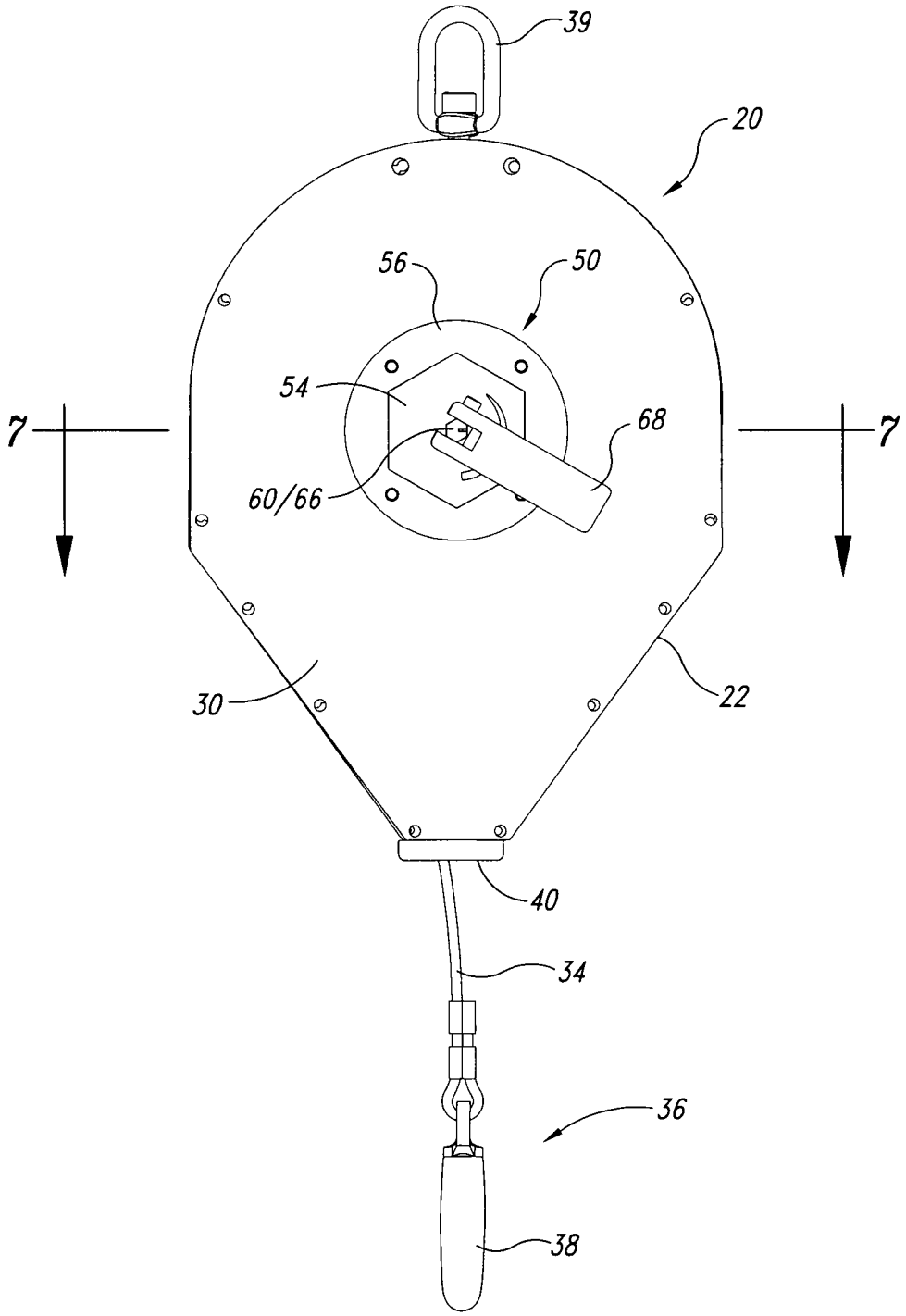
FIG. 6 is a front view of the SRL of the first embodiment with the actuation lever shown in the closed position.

Now referring to FIGS. 2-3, the SRL 20 of the present invention combines both an active fall restraint system of the prior art and a passive cable limiting mechanism that functions independent of the active fall restraint braking mechanism. SRL 20 includes many of the same features of the prior art SRL 1, including a housing 22 (which may be of nearly any shape) having an interior 24 in which a central reel housing 26 is contained and can rotate about an arbor 28. The housing 22 may contain a front plate 30 and a back plate 32, which may be interconnected by a side plate 33 or a plurality of side plates 33, as shown in the illustration. A cable 34 is capable of winding about the central reel housing 26 in retraction and winds off the reel housing 26 during cable pay out. At an external end of the cable 34 is a connector 36, such as a hook 38 as illustrated. At the other end of the housing, another connector 39 is used to secure the SRL to a fixed structure (such a support on a building) in order to tie off the SRL.

The cable 34 externally pays out from the housing 22 through an aperture 40 of the housing 22. The SRL of the present invention further includes an active braking mechanism 42 that may be like the type known in the prior art (such as a brake ring 44 and a set of pawls 46, as illustrated). Such active braking systems are well known to those of skill in the art and are not further discussed in detail.

SRL 10 further includes a power spring 48 that provides a rotating force to the central reel body in order to enable the cable to retract when the cable is paid out. The power spring is connected at one end to the arbor 28, and at the other end to the central reel body 26. The power spring can only make so many revolutions before it binds in on itself. The number of revolutions the power spring can turn before it binds in on itself is measured in terms of "turns." The present invention is directed to pretensioning the number of turns that the power spring can make in order to prelimit the distance the cable can payout to a desired distance.

Now referring also to FIGS. 4-21, the power spring 48 may be pretensioned through a passive restraint system 50 that comprises a pretension assembly. According to one aspect of the present invention, the pretension assembly includes a pair of aligned plates 52, which may include a lock plate 54 and a lock ring 56 as illustrated, a tensioner 58, and an actuator 60 that can move (e.g., open) the arbor from the aligned plates to temporarily mobilize the arbor. One of the aligned plates is fixed to the housing 22. One of the plates is secured to the housing and the other plate keeps the arbor from rotational movement as long as the plates are engaged. Once the plates are not engaged, the arbor is temporarily mobilized and can rotate. Because the arbor is connected to the power spring, the arbor rotates with the power spring, which pretensions (e.g., takes up) the cable. According to one aspect of the invention, the lock ring plate is affixed to the front plate 30 of the housing 22 through a perch or perch ring 62 through a set of fasteners 64 and a portion of the arbor 28 is engaged directly or indirectly with the other plate (e.g., with the lock ring 56).

According to another aspect of the invention, the actuator is a cammed quick release lever 66 that can easily open and close the actuator and the handle portion 68 allows the user to easily make the desired number of turns in order to pretension the power spring.

The actuator 60 is secured to the other aligned plate that is not affixed to the housing at one end and to the arbor 28 at the other end. According to one aspect of the invention, the actuator has an end portion 70 of a size and shape to mate with a generally central opening 72 of the other aligned plate (the lock ring 54, as illustrated). In this way the arbor is engaged with the lock ring and can not rotate without the plates being disengaged.

The lock ring plate and lock ring of the present invention may have a set number of mating faces 74 (six are shown) such that lock ring plate and lock ring are joined. The lock ring cannot rotate as long as the lock ring plate is secured to the housing. When the tensioner (compression spring 58) abuts the lock ring to move it away from the lock ring plate, the arbor, of which end is secured to the actuator, and in turn is secured to the lock ring, can rotate when a force is applied to it.

Figure 7:
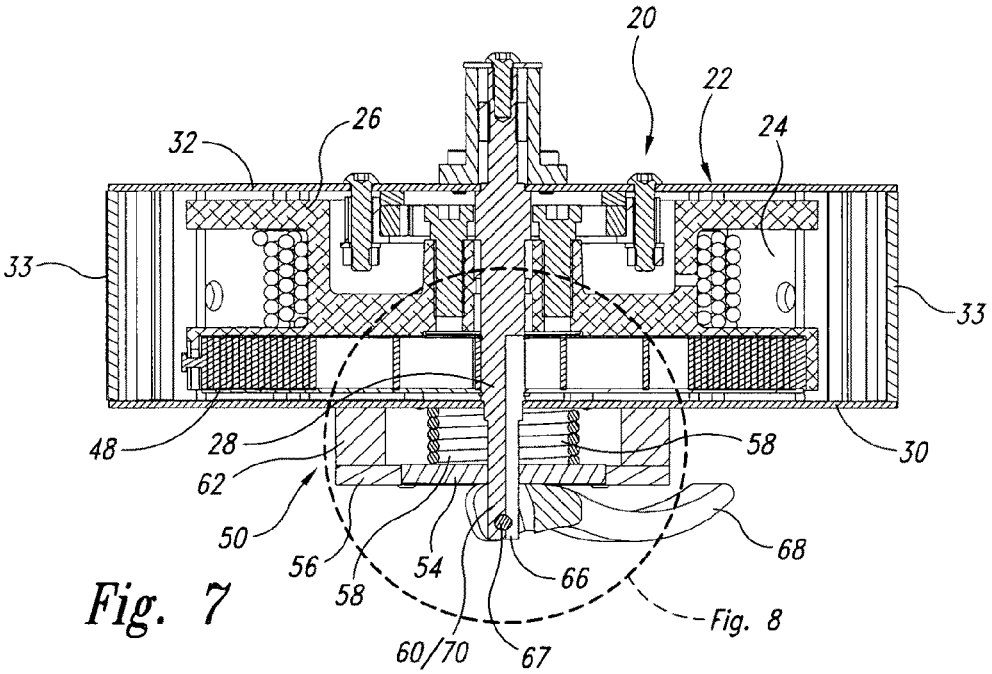
FIG. 7 is a section view taken substantially across section 7-7 of FIG. 6.
Figure 8:
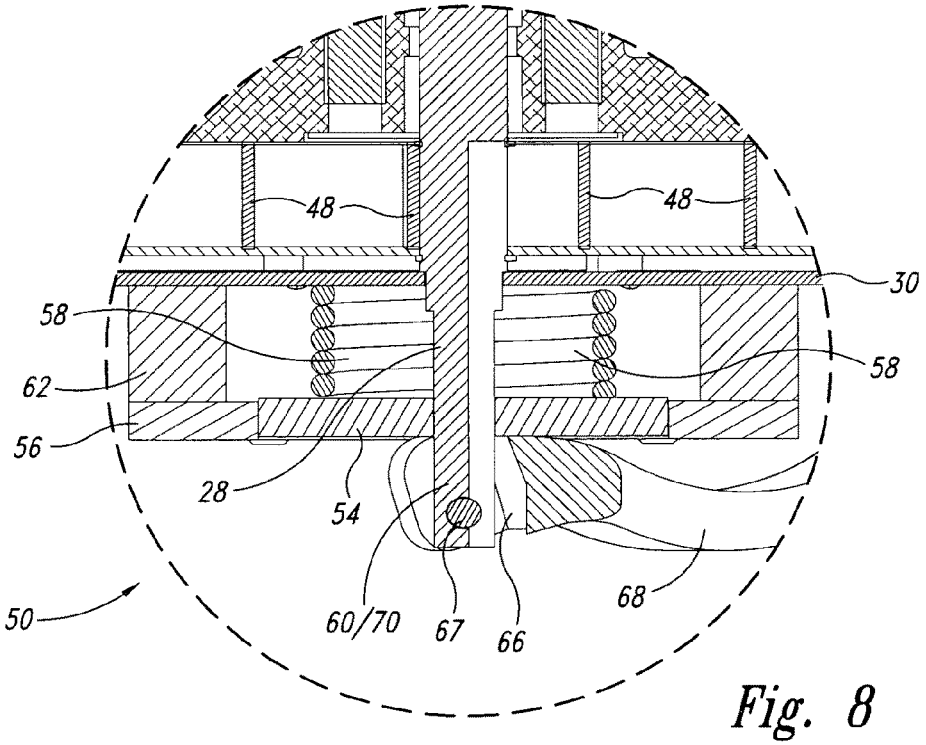
FIG. 8 is an enlarged cross-section view taken substantially at circle 8 of FIG. 7.
Figure 9:
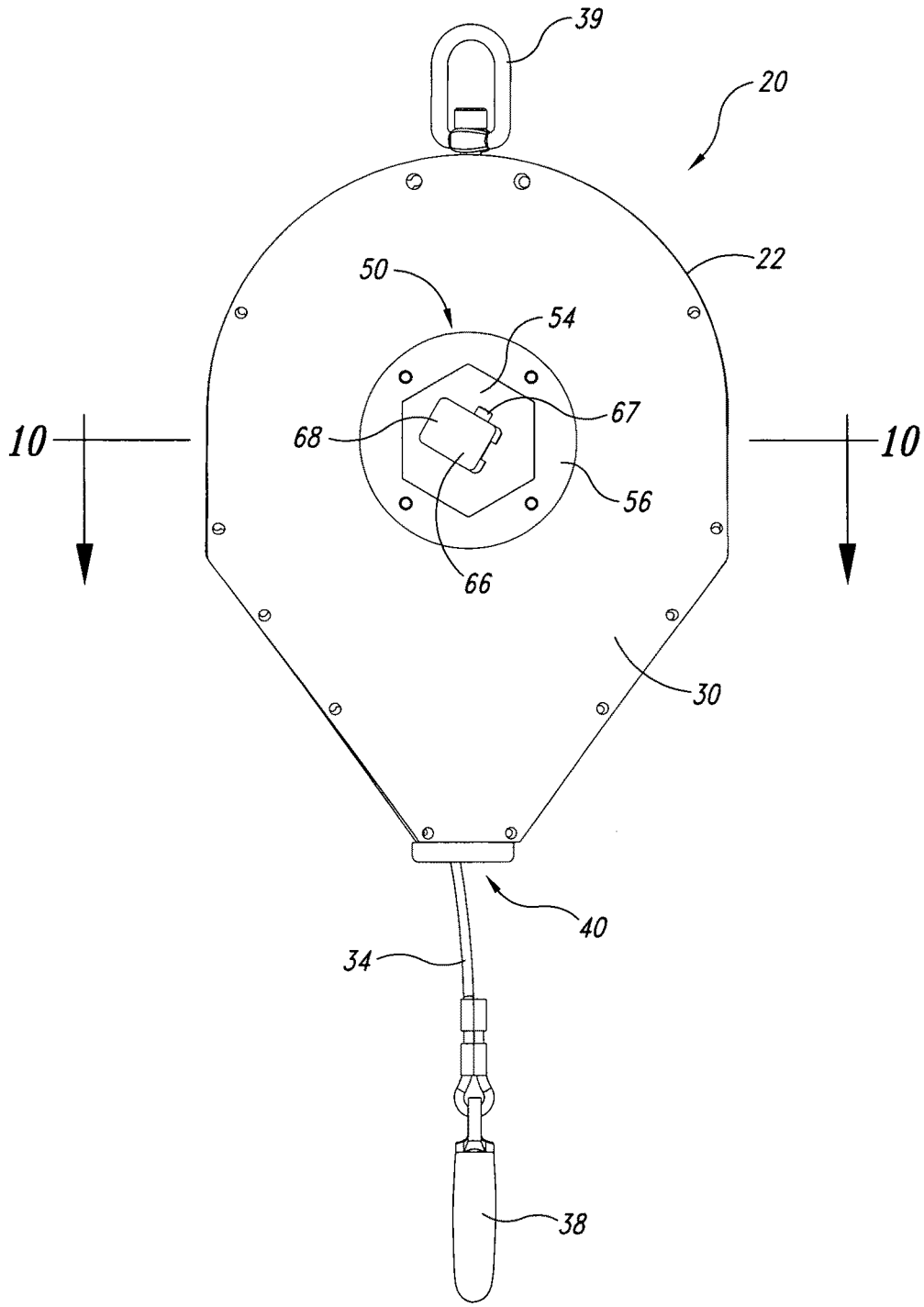
FIG. 9 is a front view of the SRL of the first embodiment illustrating the actuation switch shown in the open position and with the power spring pretensioned.
Figure 10:
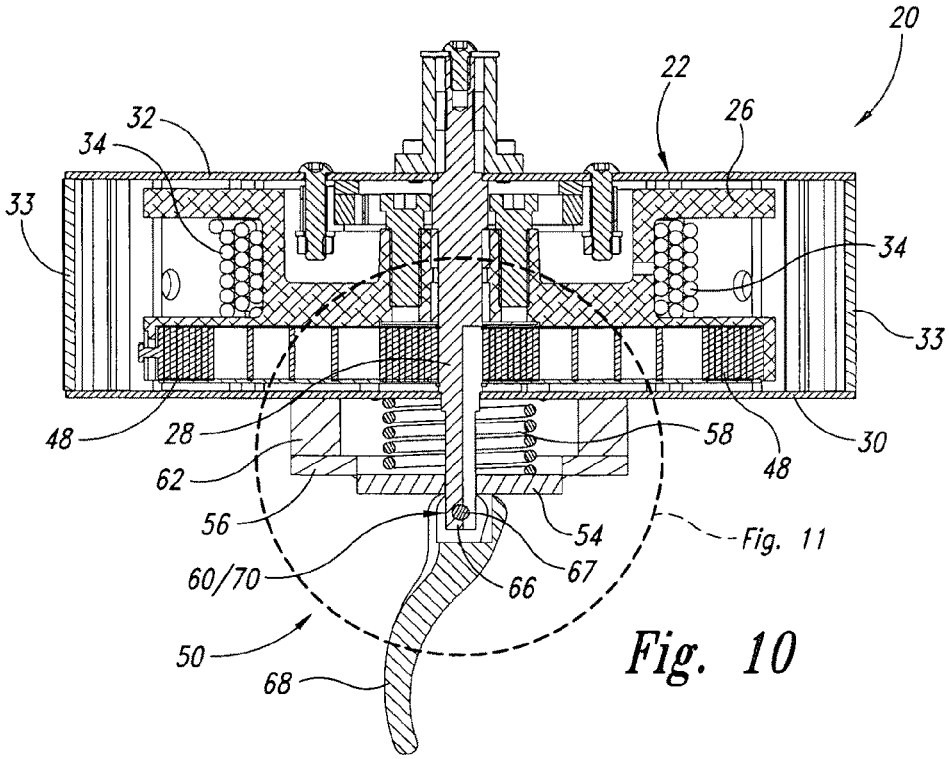
FIG. 10 is a section view taken substantially across section 10-10 of FIG. 9.
Figure 11:
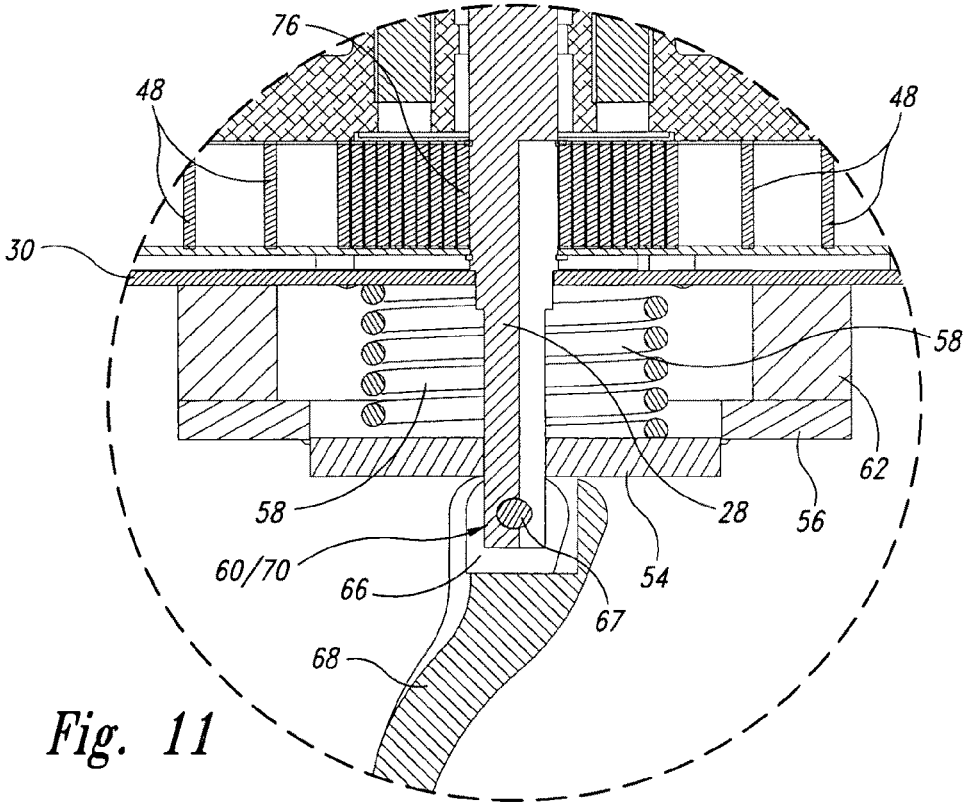
FIG. 11 is an enlarged cross-section view taken substantially at circle 11 of FIG. 10.
Figure 12:
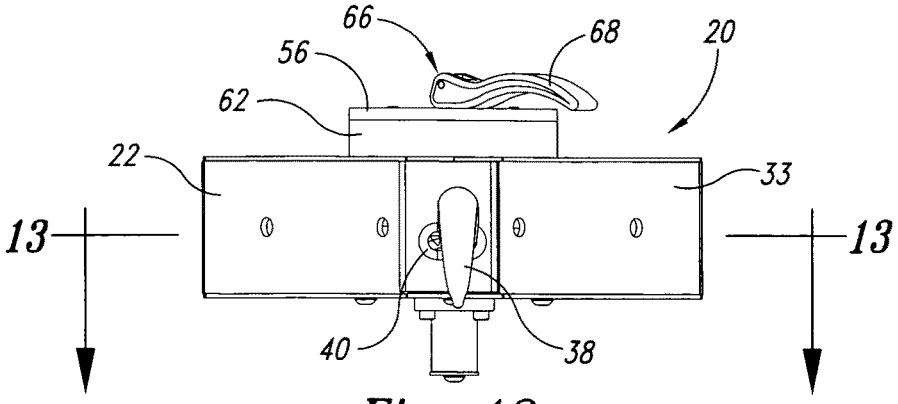
FIG. 12 is a bottom view of FIG. 2 and further illustrating a portion of SRL in the second embodiment.
Figure 13:
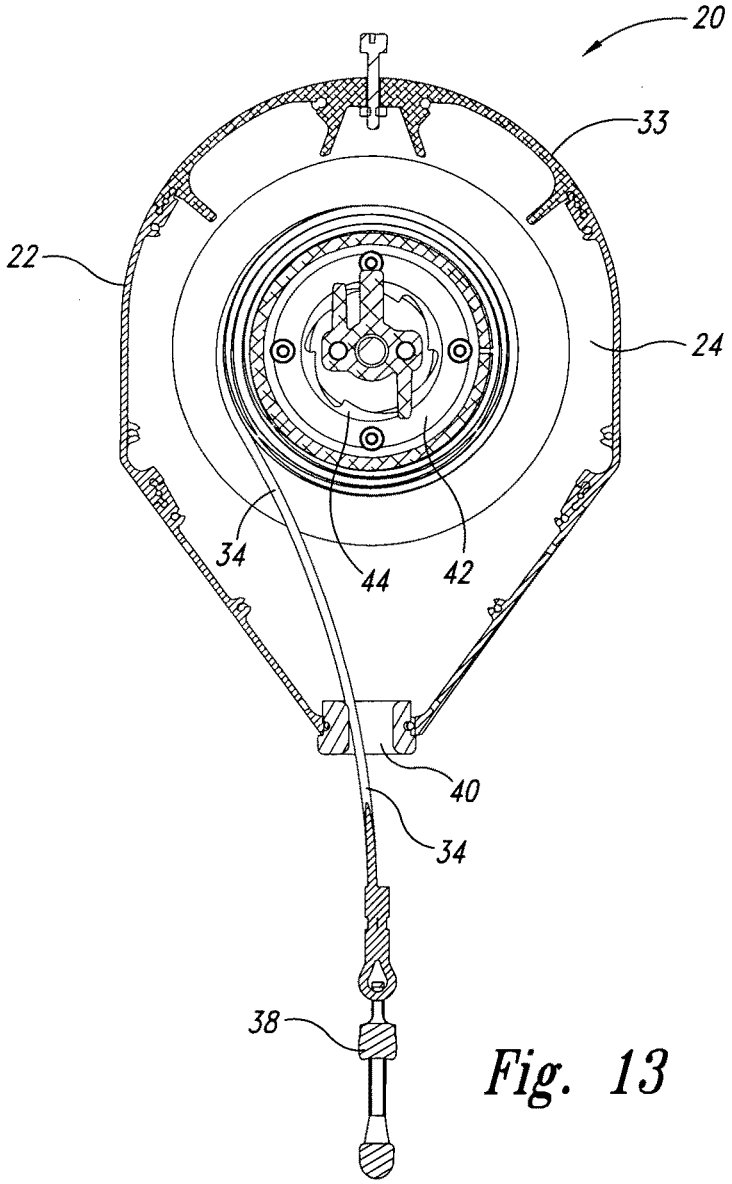
FIG. 13 a section view of the SRL taken substantially across section 13-13 of FIG. 12.
Figure 14:
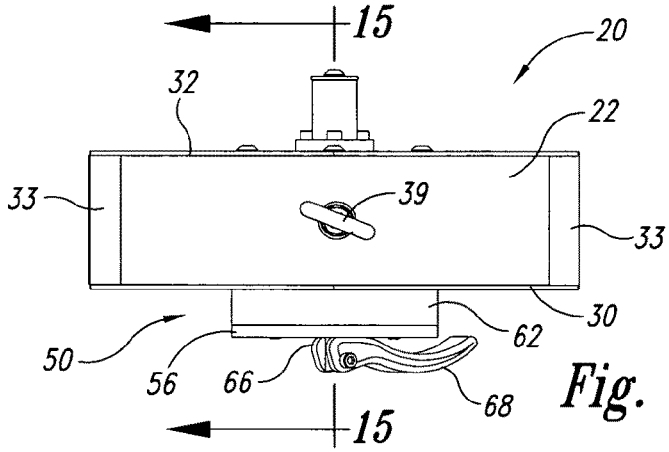
FIG. 14 is a top view of the SRL of the second embodiment.
Figure 15:
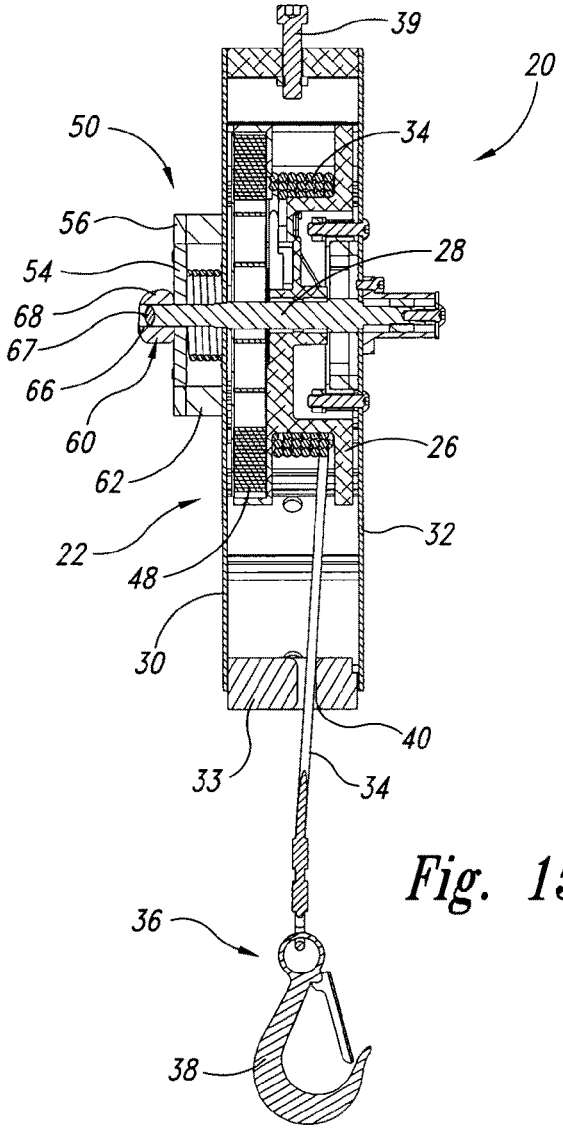
FIG. 15 is a section view taken substantially across section 15-15 of FIG. 14.
Figure 16:
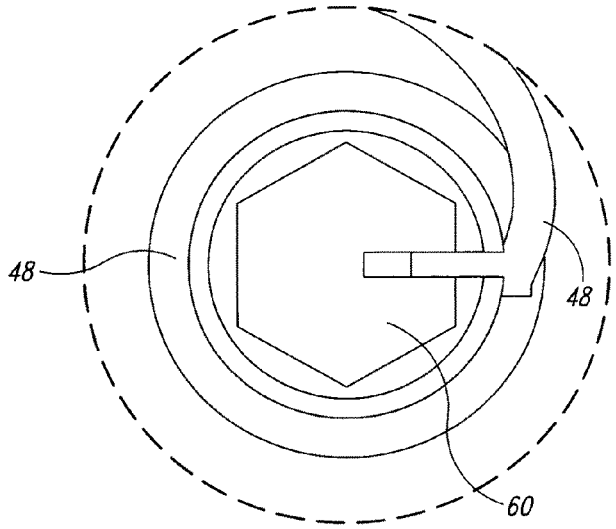
FIG. 16 is an enlarged view of circle-16 of FIG. 18.

In use, and referring to FIGS. 10 and 11, the cammed end of the quick release lever 66, which may be connected to the combined actuator/arbor by a pin or fastener 67, opens up the actuator and separates the aligned plates (the lock ring 54 from the lock ring plate 56) via the tensioner (compression spring 58). Separating the aligned plates breaks the placement of the combined actuator/arbor from its connection (however indirect) to the housing, thereby temporarily mobilizing the arbor in order to allow it to rotate or spin. To pretension the power spring, the arbor, which is connected to the interior of the power spring, is turned (preferably via the handle 68) a select number of turns. Once the user has pretensioned the power spring a desired number of turns, the quick release lever 66 is closed as illustrated in FIGS. 7 and 8, which, in turn, engages the lock ring into the lock ring plate (affixed to the housing) and the arbor is no longer mobilized.

Again referring to FIG. 4, the geometric relationship between the end of the actuator 70 and the center 72 of the lock ring 54 that receives the end of the actuator 70 may be used to determine the ratio of cable distance limiting when the power spring makes a complete turn. Here, the geometric shape is hexagonal, thus determines the "resolution" of the distance limiting function. In the example, having six sides may limit a cable to 37, 40, 43, and 46 feet while having seven sides may limit a cable to 37, 39, 41, 43, and 45 feet. While six sides are illustrated, other numbers can be used (e.g., three, four, five, seven, eight, nine, ten, etc.).

One complete turn would limit the cable payout by the circumference of cable wrapped around the reel. However, because the somewhat helical and spiral nature of a cable wrapped around a reel, this number is not a constant. In the illustrated embodiment, there are roughly 40 turns of cable on the reel body. Each $1/6^{th}$ of a rotation of the quick release handle roughly translates into $1/6^{th}$ of the circumference of the cable being taken up in length. Using a rough linear estimate, each revolution of the handle decreases cable length by $65/40$ of 1.625 feet. However, in reality, the regression of turns to amount of cable limited would more likely resemble a logarithmic regression with a currently unknown coefficient.

Figure 17:
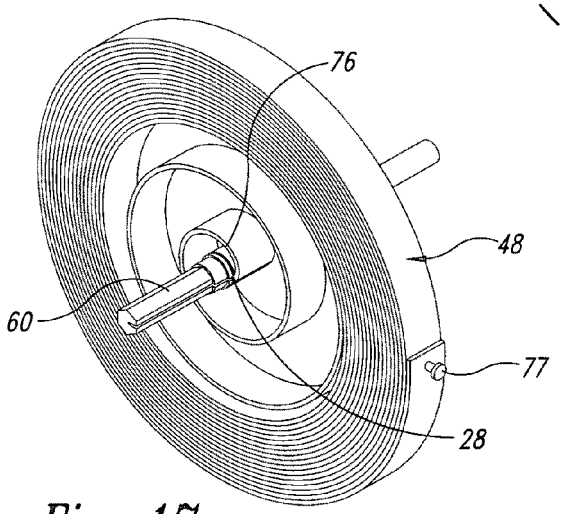
FIG. 17 is a perspective view of the power spring and the arbor.
Figure 18:
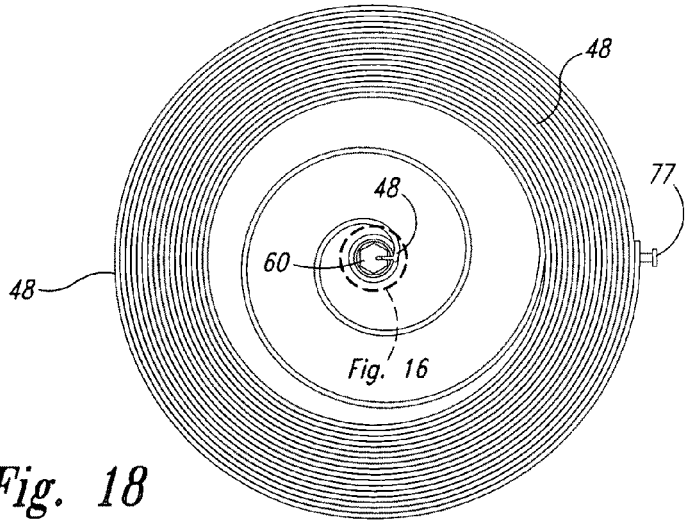
FIG. 18 is a front view of the power spring and arbor.
Figure 19:
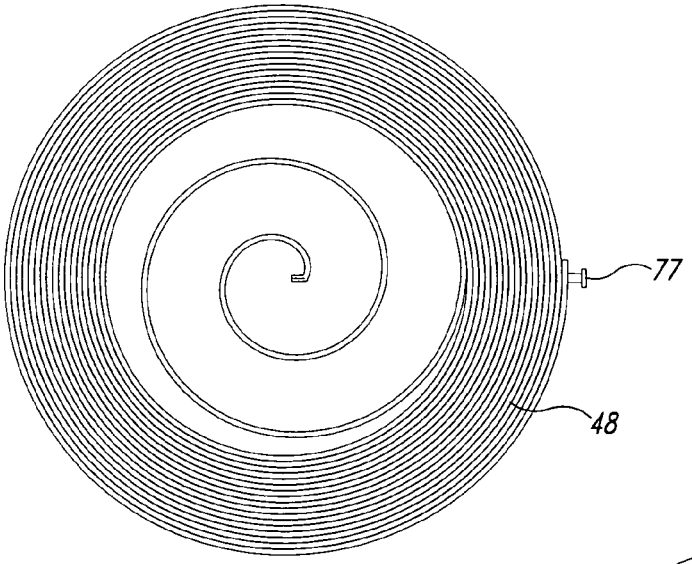
FIG. 19 is a schematic view showing the power spring illustrated with no pretension.
Figure 20:
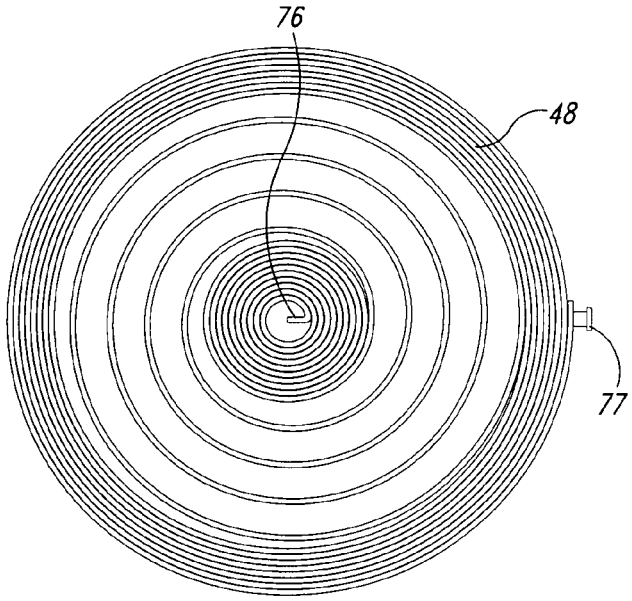
FIG. 20 is a schematic view of the power spring illustrated with some pretension.
Figure 21:
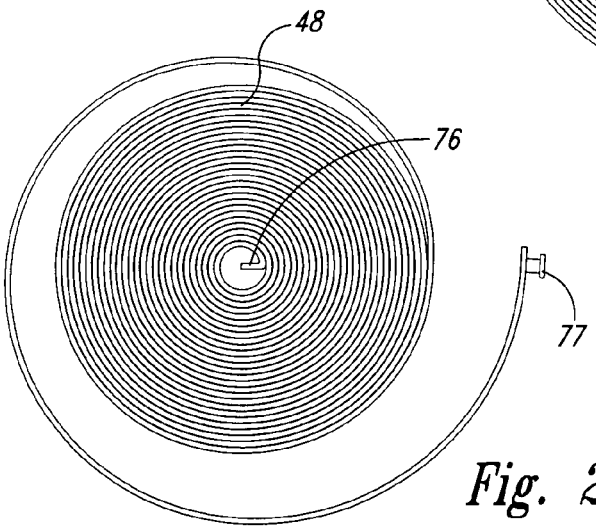
FIG. 21 is a schematic view of the power spring illustrated with full or substantially full pretension.

As stated above, the interior 76 of the power spring 48 is connected to the arbor 28. This is best illustrated in FIGS. 17 and 18. When the arbor is mobilized and "turned" by the actuation lever, the power spring is wound to a pretensioned setting (such as illustrated in FIG. 21). The illustration of FIG. 21 is at maximum pretensioning, the illustration of FIG. 20 is a mid-range pretensioning setting. The illustration of FIG. 19 shows no pretensioning.

FIGS. 17-21 further illustrate a pin 77 or other fastener to fasten the other end of the power spring to the central reel body.

Referring to FIGS. 22-25, other pretension assemblies 50', 50", and 50'" include variations on the pair of aligned plates. In the embodiment illustrated in FIGS. 22 and 23, plate 78 may include a plurality of pins 80 that may be received into corresponding apertures 82 of an engaging plate 84. The plate closest to the housing is secured to the housing 22 (in the illustration, it is plate 84). When engaged, the plates are prohibited from rotational movement. This prohibition may be accomplished through the use of a geometrical locking arrangement of the actuator/quick release handle relative to an opening in the plate farthest from the housing, similar to the disclosure in the first embodiment. The illustration shows the familiar hex shape actuator/arbor corresponding to a hex shaped opening of the anterior plate, but other polygonal shapes can be used.

When the plates are disengaged, such as through a quick release handle 66 and actuator 60 via a tensionser, such as a compression spring 58, the combined actuator/arbor 28/60 is no longer fixed to the house and may rotate or spin. Because the arbor is connected to the power spring, rotating the arbor rotates the power spring and pretensions the cable.

Figure 22:
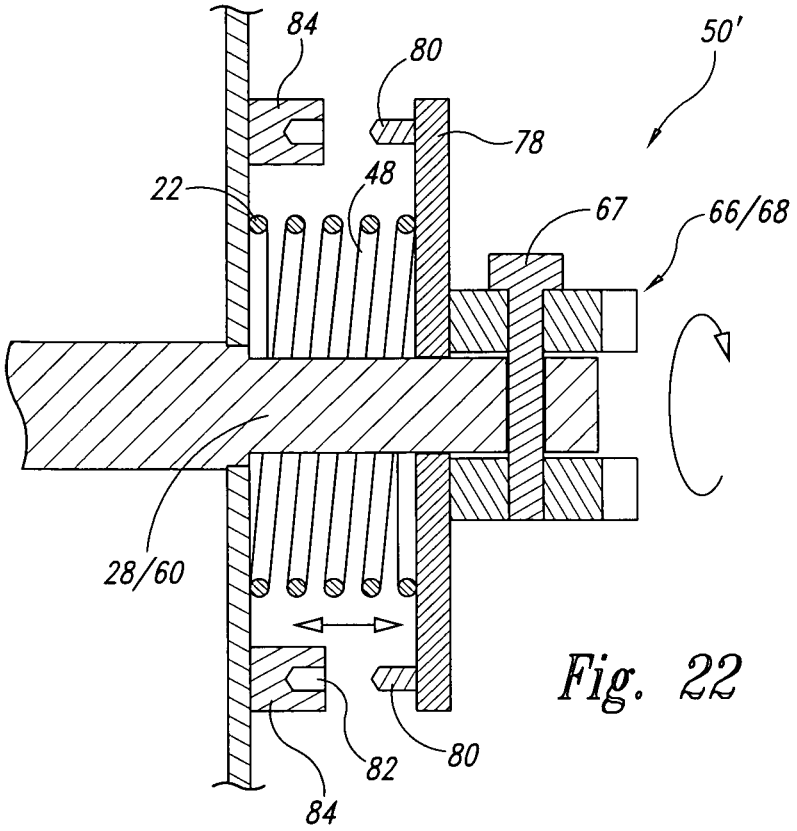
FIG. 22 is a side view of a second embodiment of the pretension assembly in the unlocked (mobilized arbor) position.
Figure 23:
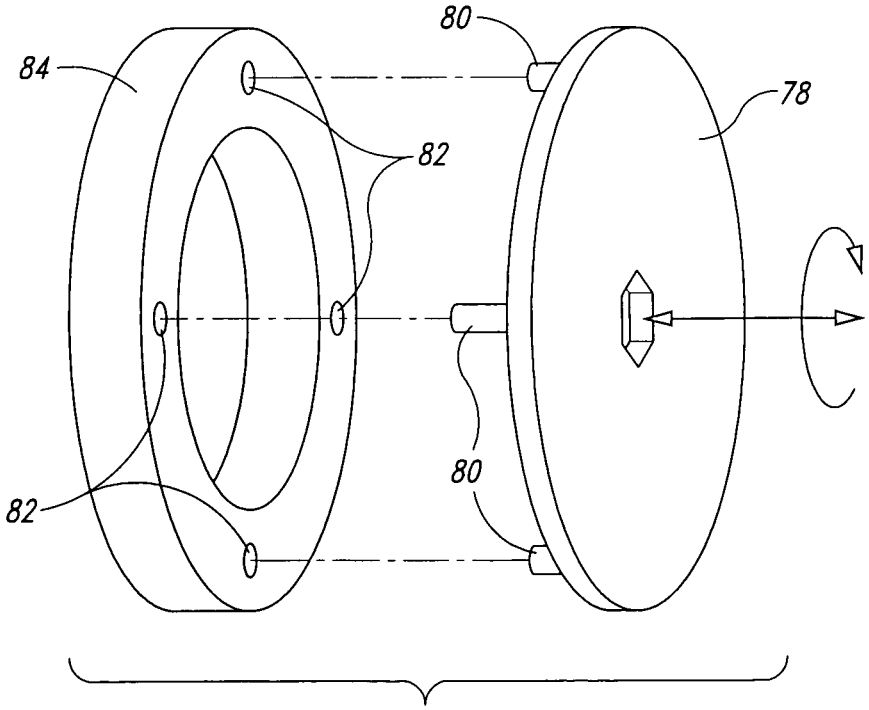
FIG. 23 is a perspective view illustrating a perch with a plurality of apertures about to receive a second plate via its plurality of pins.
Figure 24:
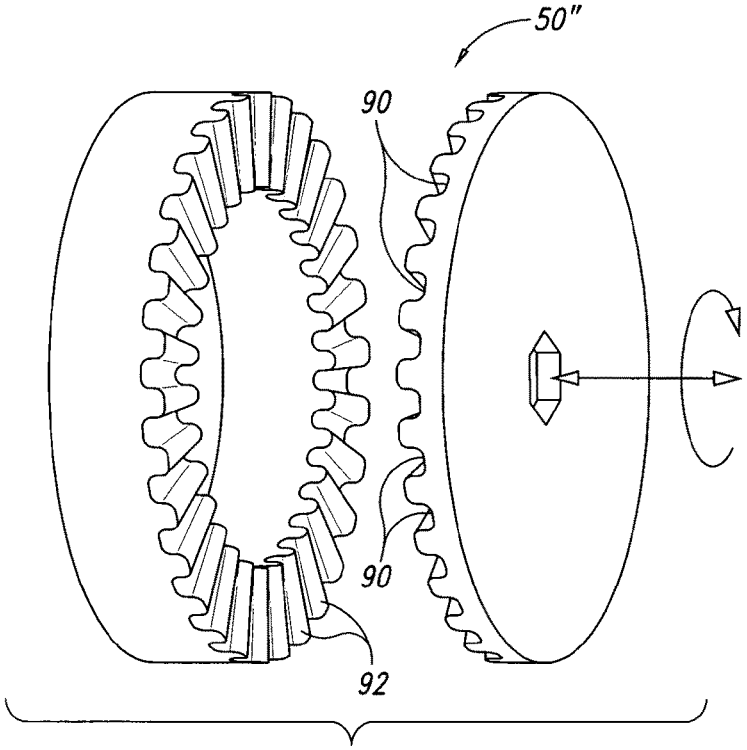
FIG. 24 is a perspective view illustrating a third embodiment of the pretension assembly.

In the embodiment illustrated in FIG. 24, the engaging plates 86, 88 may have corresponding splines/teeth 90, 92 as opposed to the pins/apertures of FIGS. 22 and 23. The splines/teeth engage corresponding splines teeth of the other plate. When engaged, the plates are locked to the housing and prohibit movement of the arbor. When the plates are disengaged, the arbor is no longer secured (although indirectly) to the housing and the arbor can then be rotated.

Figure 25:
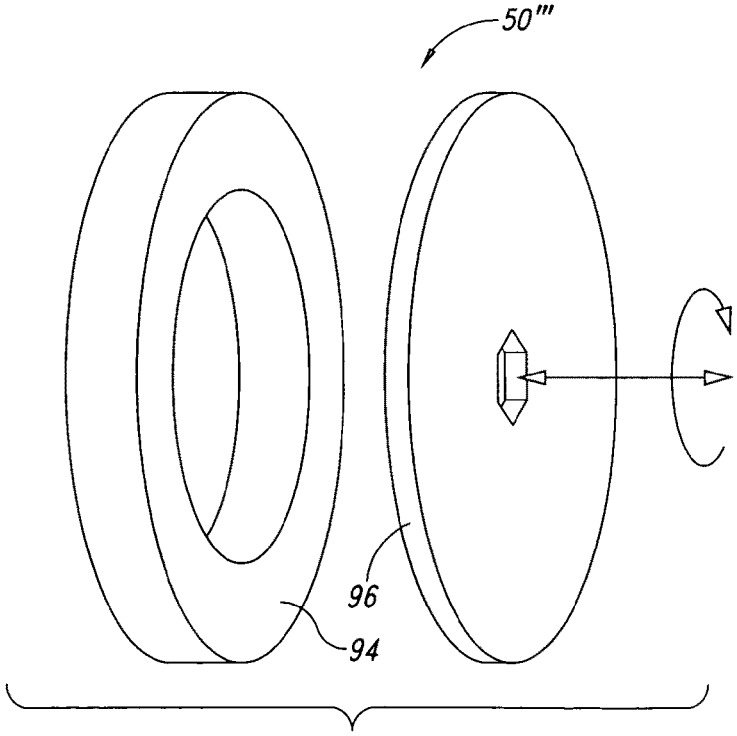
FIG. 25 is a perspective view illustrating a fourth embodiment of the pretension assembly.
Figure 26:
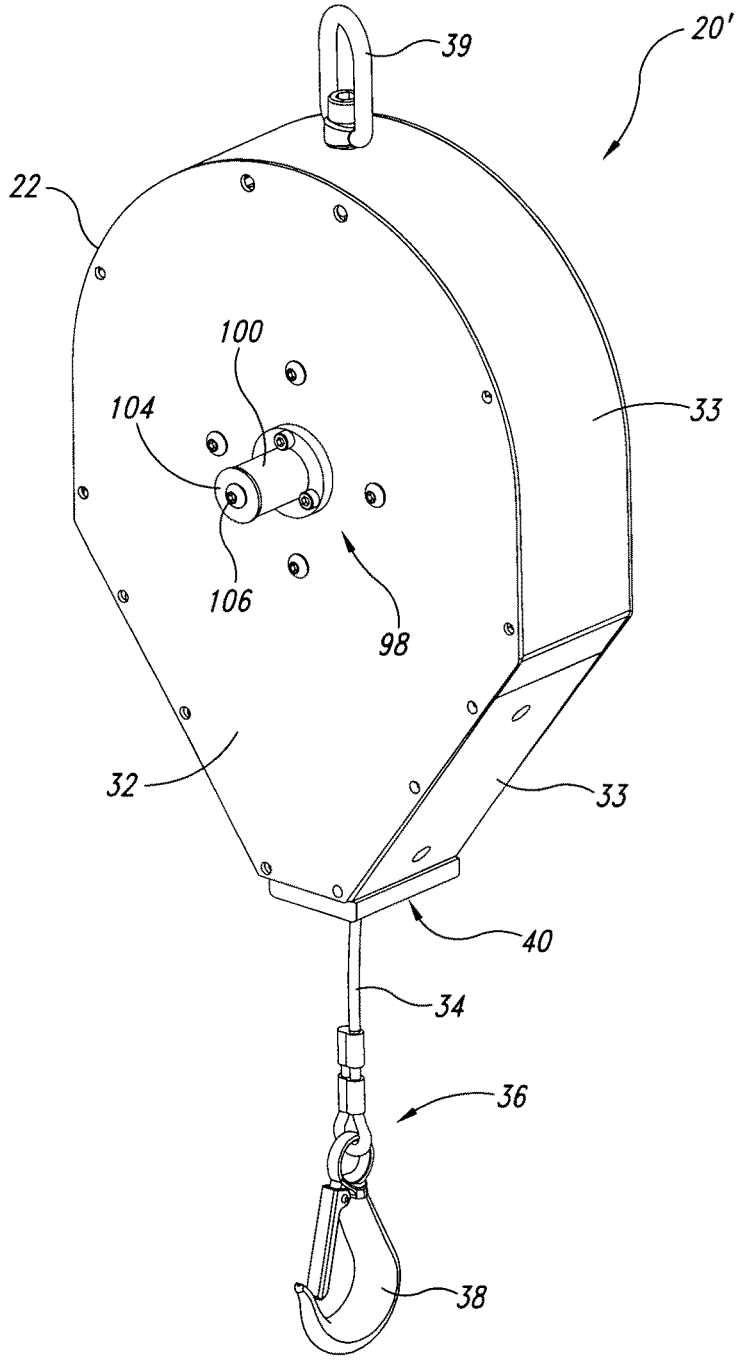
FIG. 26 is a perspective view of the second embodiment of the SRL of the present invention as viewed from the rear.
Figure 27:
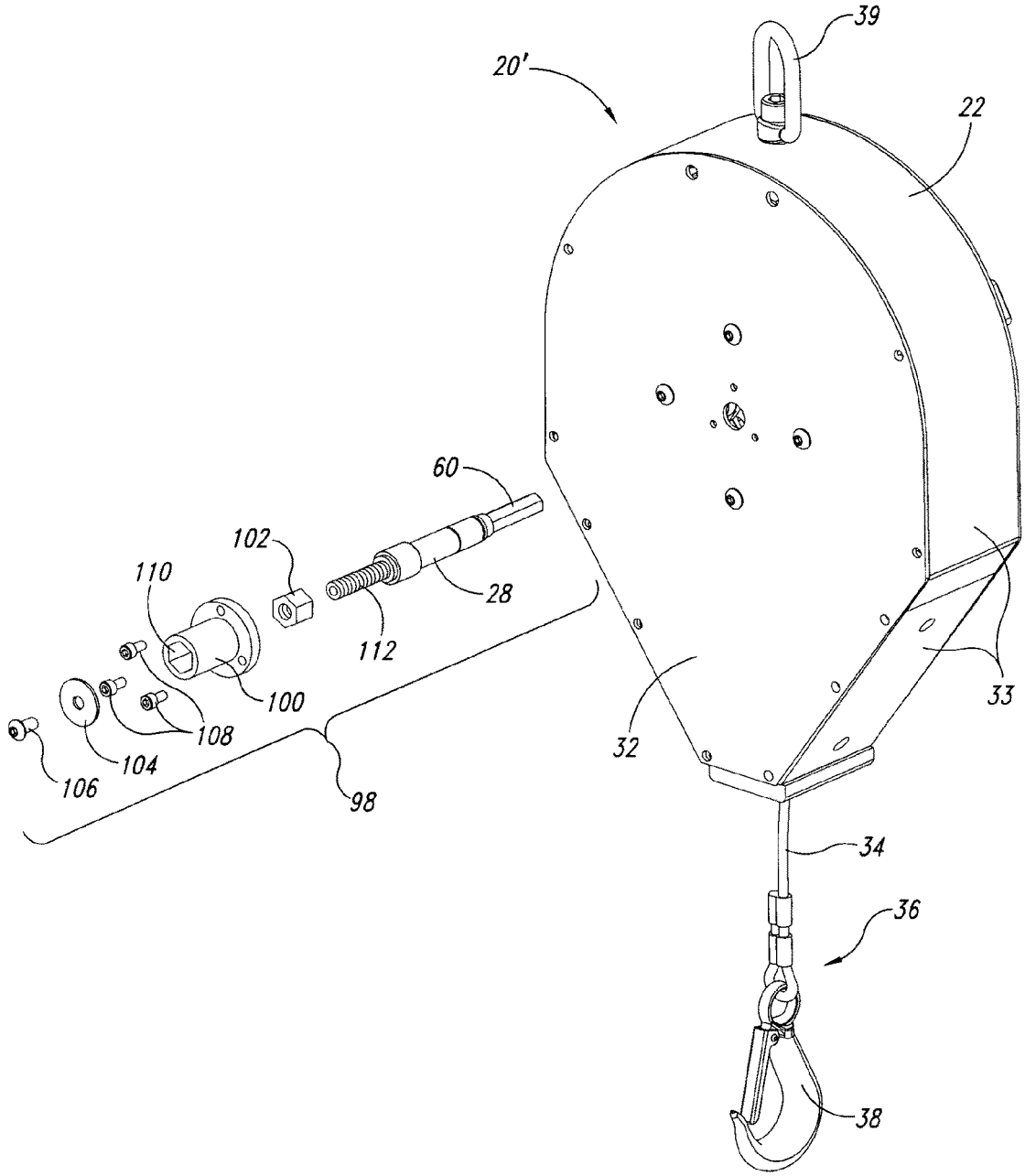
FIG. 27 is an exploded perspective view of FIG. 26 and better illustrating the overtensioning elimination mechanism.
Figure 28:
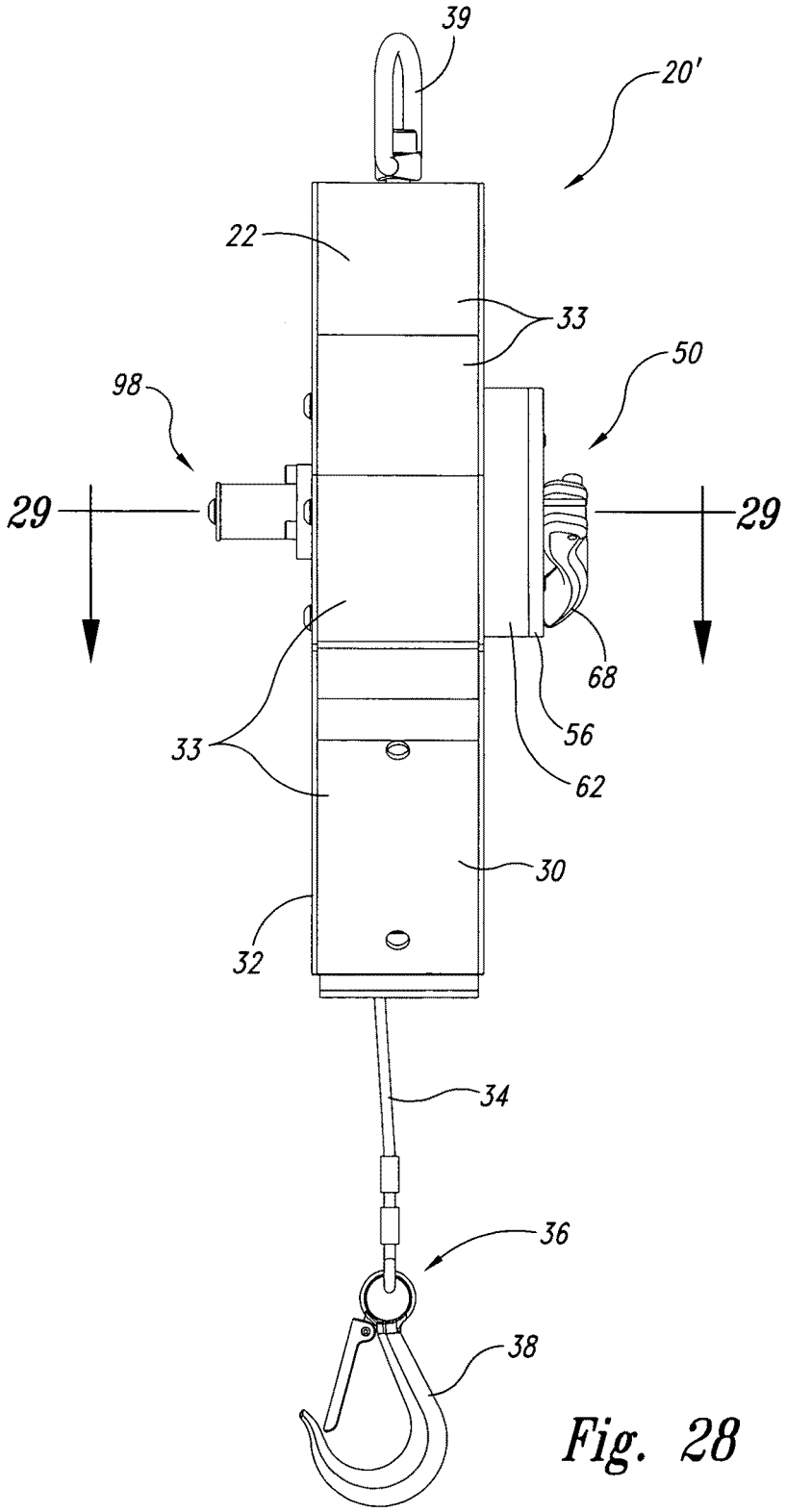
FIG. 28 is a side view of FIG. 26.

Another embodiment of FIG. 25 where friction between two corresponding smooth plate surfaces 94, 96 are used to create a force to transmit torque. Such torque is transmitted by the geometrical locking arrangement of the actuator/quick release handle relative to an opening in the plate farthest from the housing. The smooth plates create a "friction force" between them when engaged and it is the action of the quick release lever that exerts a "normal force" that overcomes the friction and the torque of the tensioner (the spring). When the quick release lever is disengaged, the normal force effectively drops to zero, as does the frictional force, thereby rendering the arbor mobile.

A second SRL embodiment 20' of the invention is best illustrated in FIGS. 26-30 with (limited additional disclosures shown in FIGS. 7, 10, 12, 14, and 15), in which overtension eliminating mechanism 98 is added to the opposite end of the arbor to prevent the power spring from being overtensioned due to user error. The overtension eliminating mechanism 98 further includes turning so far that it no longer retains a minimum amount of pretensioning and avoiding the possibility of user error. The overtension eliminating mechanism is designed to reduce and preferably eliminate overtensioning through the use of a pair of fittings.

As illustrated, the fittings are a spin stop fitting 100 and a spin stop nut 102 in which the exterior shape of the spin stop nut corresponds to the interior shape of the spin stop fitting. An end plate 104 and a fastener 106 abut the end of the spin stop fitting 100. The spin stop fitting 100 is affixed to the SRL housing 22 (illustrated affixed to back plate 32 through a plurality of fasteners 108). According to one aspect of the invention, the spin stop nut is a hex nut and the interior space 110 of the spin top fitting 100 is of a size and shape to receive the hex head nut and to keep it from rotational, but not lateral, movement. However, other geometrical shapes beyond a hexagonal shape may be used and the use and interchangeability of other shapes are well within the scope of one of skilled in the art.

Figure 30:
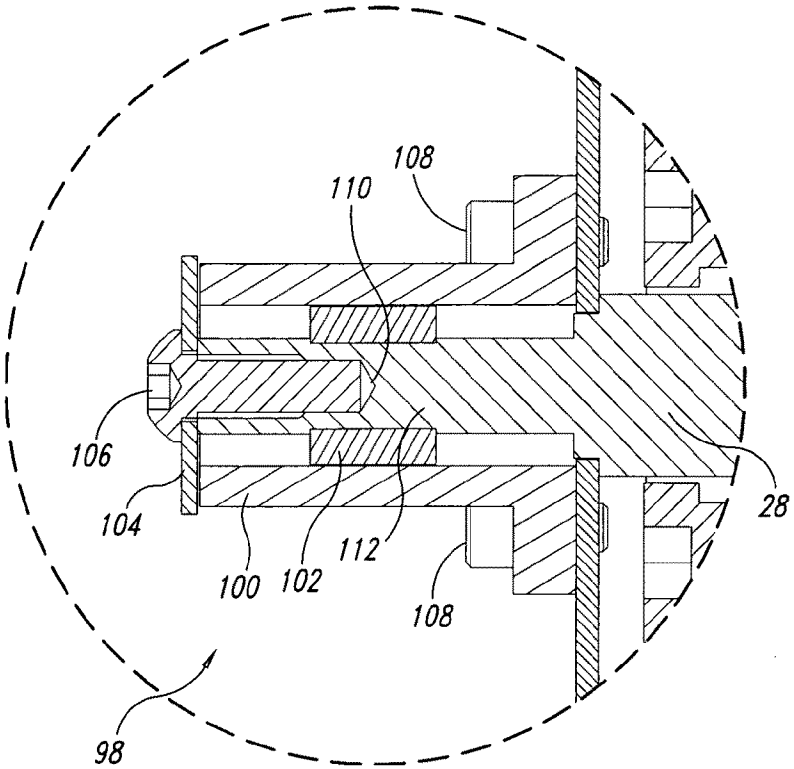
FIG. 30 is an enlarged view of a cross-section view of FIG. 29 taken substantially at circle—30 and better illustrating the features of the overtension reduction or elimination mechanism.
Figure 29:
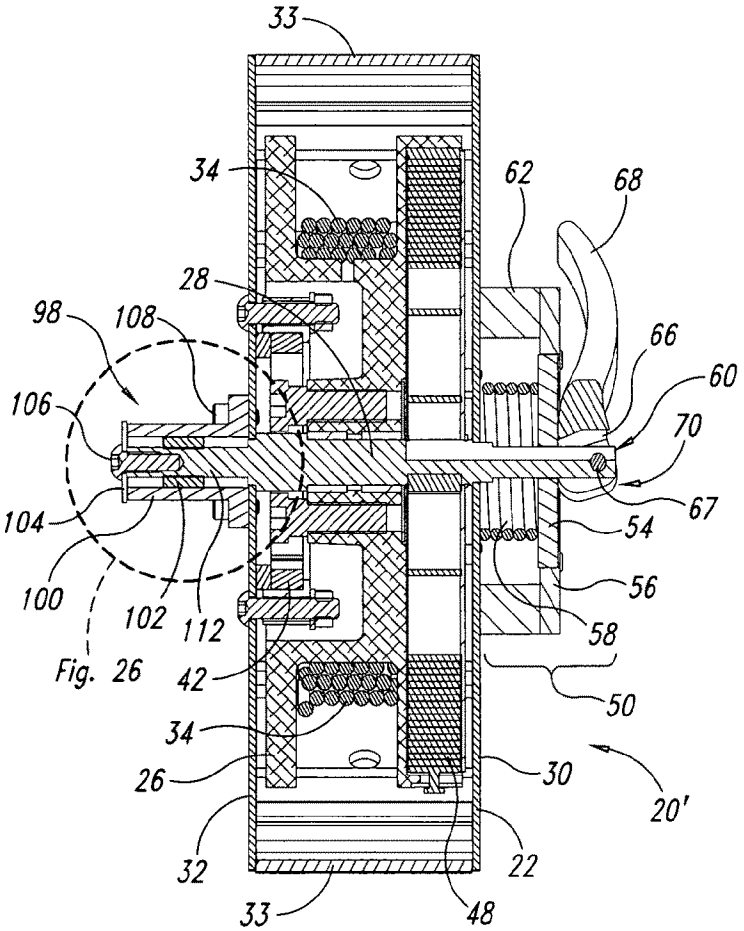
FIG. 29 is a section view taken substantially along lines 29-29 of FIG. 28.

The anterior end 110 of the fastener can abut the other end 112 of the arbor 28, which may be threaded, and can engage the spinnable threaded nut 102 as illustrated in FIG. 29 and enlarged detail FIG. 30 in the event that the arbor 28 (via the spinnable threaded nut) moves too far in pretensioning the power spring. According to yet another aspect of the invention, the arbor end 112 is of a size and shape to allow the arbor be received into and move inside the hex nut 102. The geometrical configuration is a threaded cylindrical arbor end 112 that can be received and move within a threaded nut. However, other geometrical shapes may be used (a smooth cylinder, for example). Once the hex nut 102 abuts the end plate 104, the power spring can no longer be pretensioned (wound).

Figure 31:
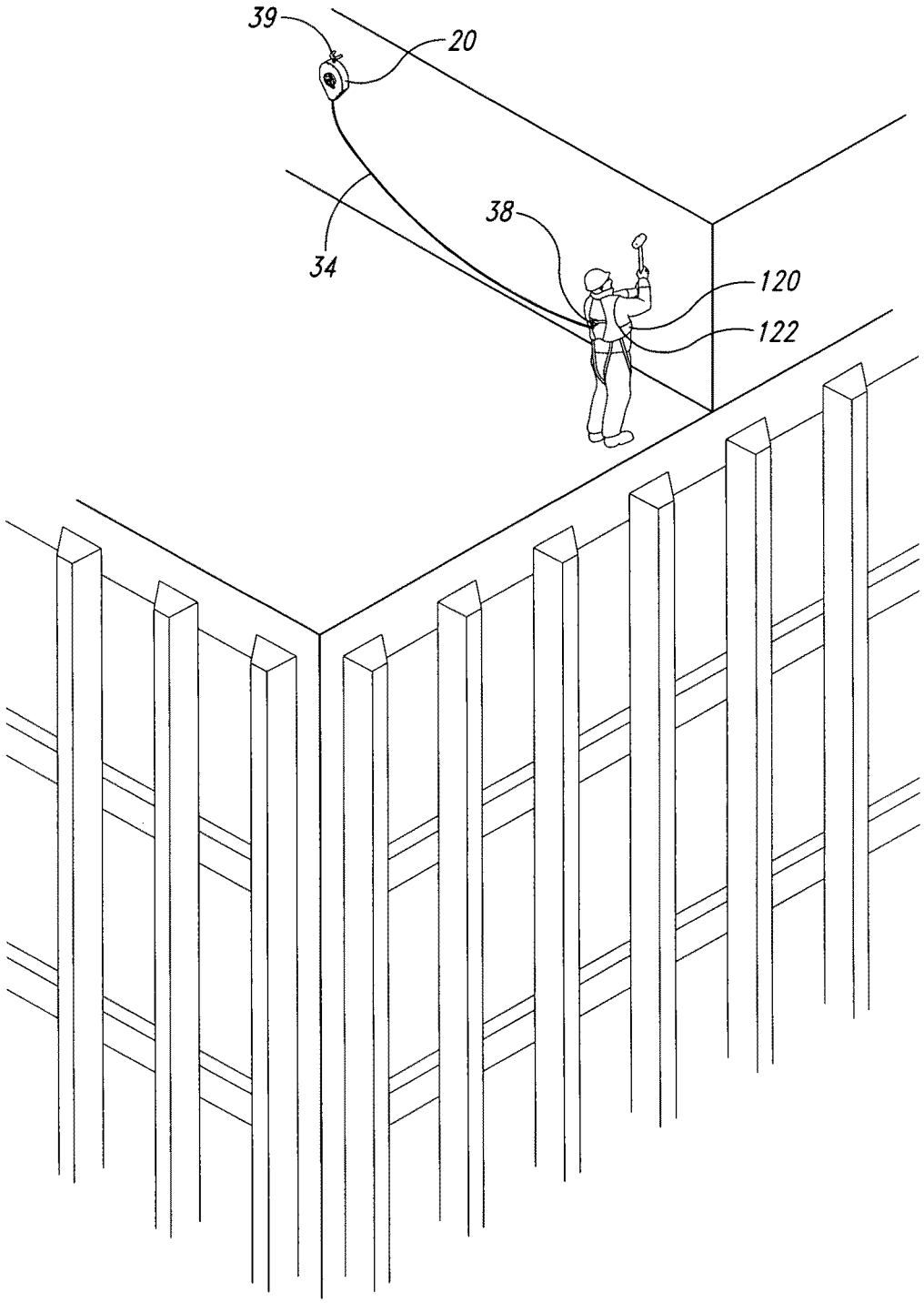
FIG. 31 is a perspective view illustrating the SRL of the second embodiment as used passively and actively by worker atop a high rise.

Because the passive restraint system functions independently of the active braking mechanism, the SRL includes both an active braking system for fall arrest and a passive fall restraint system. In use, such as illustrated in FIG. 31, a wearer 120 connects the hook 38 of the SRL 20 to a wearer's safety harness 122 (typically through a D-ring or other ring). The SRL connector 39 is affixed to structural support at the work environment (building 124 as illustrated) in order to secure and tie off the SRL. In the illustrated example, the wearer 120 is atop of a high building 124 where the active braking system will prevent a life threatening fall off the building. However, the wearer has only a set amount of distance X in which the wearer will fall off the building. If the wearer is using a 65' SRL retractable, but the distance off the building is only 30 feet, the safe thing to do is to limit the cable payout to something slightly less than 30 feet. In the present application, the user limits the number of turns to limit the cable payout 36 feet, which would put the available cable payout at approximately 29 feet (the desired distance in the illustration).

Advantages of the present invention include having a single device that can provide both active fall arrest and a passive restraint. If the wearer is passively restrained, the wearer is that much less likely to have need for true fall arrest protection even though such protection exists in a fully functioning mode. This invention provides an additional safety feature for workers in hazardous locations. Further, the present invention allows for a single active fall arrest device that can be used in a multitude of applications as a commercialized 65' retractable can also function as 50' foot or less retractable by pretensioning the cable pay out to a desired length. Thus, users and contractors will not have to stock as many variations and parts and construction and maintenance companies can save on inventory costs without sacrificing on safety.

The illustrated embodiments are only examples of the present invention and, therefore, are non-limitive. It is to be understood that many changes in the particular structure, materials, and features of the invention may be made without departing from the spirit and scope of the invention. Therefore, it is the Applicants' intention that their patent rights not be limited by the particular embodiments illustrated and described herein, but rather by the following claims interpreted according to accepted doctrines of claim interpretation, including the Doctrine of Equivalents and Reversal of Parts.

What is claimed is:

1. A self-retracting lifeline ("SRL") having both an active fall restraint braking system and a passive restraint system; the lifeline comprising:

a housing defining an interior having an aperture;

a central reel rotatable within the confines of the interior in which the central reel rotates about an arbor;

a length of cable that is wound about the reel in which one end of the cable is fixed to the central reel and the other end can extend outside of the housing through the aperture;

an active braking mechanism that is capable of quickly stopping the cable from paying out upon sensing a predetermined condition;

a power spring having an outer end and an interior portion that is connected to the arbor;

said power spring is capable of retracting the cable back into the housing about the central reel when the cable is paid out or is taken in before the power spring binds in on itself, the outer end of the power spring being secured to the central reel;

a pair of aligned plates capable of being disengaged to mobilize the arbor in order to rotate and wind the power spring, wherein one of the aligned plates is secured to the housing and the other plate is securable to a portion of the arbor such that when the plates are engaged the arbor is prohibited from movement; and an actuator that is connected to the arbor and can temporarily mobilize the arbor when the actuator is activated and applies a tensioning force to disengage the aligned plates.

2. The SRL of claim 1 wherein the actuator is a cammed actuation lever.

3. The SRL of claim a wherein the lever further comprises a quick release lever and a handle.

4. The SRL of claim 1 further comprising a tensioner in order to apply a tension force to the aligned plates.

5. The SRL of claim 4 wherein the tensioner is a compression spring.

6. The SRL of claim 1 wherein the pair of aligned plates comprises a polygon shaped lock ring and a corresponding lock ring plate.

7. The SRL of claim 6 further comprising a perch ring to secure the lock ring plate to the housing.

8. The SRL of claim 6 wherein the lock ring is hexagonal in shape.

9. The SRL of the claim 6 wherein the actuator is a cammed quick release lever and handle assembly.

10. The SRL of claim 1 further comprising an overtension elimination mechanism.

11. The SRL of claim 10 wherein the overtension elimination mechanism further includes a pair of fittings in which one of the fittings is secured to the housing and the other fitting is used to stop the end of the arbor opposite that which is secured to the actuator from lateral movement beyond a certain point.

12. The SRL of claim 11 wherein the pair of fittings further includes a spin stop fitting and a corresponding spin stop nut.

13. The SRL of claim 12 wherein the spin stop nut comprises an internally threaded hex nut.

14. The SRL of claim 11 further comprising an end plate and fastener secured to the spin stop fitting opposite where the spin stop fitting is secured to the housing.

15. An SRL having a cable payout, the SRL having both an active fall restraint braking system for stopping an adult worker from falling when attached to the cable of the SRL, and a passive restraint system to limit the length of the cable payout: the SRL comprising:

a housing defined by an interior having an aperture;

a reel fixed to the interior in which the reel rotates about an arbor;

a length of cable that is wound about the reel in which one end of the cable is fixed to the reel and the other end capable of extending outside of the housing through the aperture a set length and includes a connector to attach to a garment worn by an adult worker;

the power spring capable of retracting the cable back into the housing about the reel;

an active braking mechanism that is capable of quickly stopping the cable from paying out upon sensing a predetermined condition; and a passive distance limiting mechanism including a power spring that functions independently of the active braking mechanism and prelimits the amount of cable pay out a desired distance, wherein the passive distance limiting mechanism further includes a pair of engaged aligned plates in which one plate is fixed to the housing the other is fixed to an actuator that is fixed to the arbor, said aligned plates are capable of being temporarily disengaged in order to temporarily mobilize the arbor in order to pretension the power spring.

16. The SRL of claim 15 wherein the aligned plates comprise a lock ring and a lock ring plate and the lock ring plate is affixed to the housing.

17. The SRL of claim 15 wherein the actuator is a cammed quick release activation lever and handle assembly.

18. The SRL of the claim 15 wherein the aligned plates can be disengaged through a tension spring.

19. The SRL of the claim 15 further comprising an overtension elimination mechanism including a pair of fittings in which one of the fittings is secured to the housing and the other fitting is used to stop the end of the arbor opposite that which is secured to the actuator from lateral movement beyond a certain point.

20. The SRL of claim 15 wherein the aligned plates further comprise a plurality of projecting pins on one plate and a plurality of corresponding apertures on the other plate.

21. The SRL of claim 15 wherein the aligned plates further comprise a plurality of splines/teeth on one plate and a plurality of corresponding splines/teeth on the other plate.

22. A method of combining an active fall restraint SRL with passive restraint functionality, the method comprising:

providing a housing having (i) an interior with an aperture, (ii) a reel rotatable within the confines of the interior in which the reel rotates about an arbor that is capable of being mobilized and immobilized, (iii) a length of cable that is wound about the reel in which one end of the cable is fixed to the reel and the other end is capable of extending outside the housing through the aperture a set distance, (iv) an active braking mechanism capable of quickly stopping the cable from paying out upon sensing a predetermined condition when the arbor is immobilized, and (v) a passive distance limiting mechanism having a power spring capable of being wound, wherein the power spring has an interior end and exterior end with the interior end being attached to the arbor and the exterior end secured to the reel, and wherein said passive distance limiting mechanism functions independently of the active braking mechanism and is capable of prelimiting the amount of cable pay out when the arbor is mobilized;

temporarily mobilizing the arbor;

winding the power spring a set number of turns to pretension the power spring and, thereby taking up a desired portion of the cable length capable of being paid out; and rendering the arbor immobile to allow the active braking mechanism to function, wherein the passive distance limiting mechanism further includes a pair of aligned plates capable of being disengaged to mobilize the arbor m order to rotate and wind the power spring, wherein one of the aligned plates is secured to the housing and the other plate is securable to a portion of the arbor such that when the plates are engaged the arbor is prohibited from movement; and an actuator that is connected to the arbor and can temporarily mobilize the arbor when the actuator is activated and applies a tensioning force to disengage the aligned plates.

23. The method according to claim 22 wherein the actuator is a cammed quick release lever and handle assembly where the handle is accessible outside the housing; and wherein the handle is turned to wind the power spring to take up the desired portion of cable length from being paid out.

24. A method of providing a worker active fall restraint braking with passive fall restraint functionality; the method comprising:

providing a housing having (i) an interior with an aperture, (ii) a reel rotatable within the confines of the interior in which the reel rotates about an arbor that is capable of being mobilized and immobilized, (iii) of cable that is wound about the reel in which one end of the cable is fixed to the reel and the other end is capable of extending outside the housing through the aperture a set distance, (iv) an active braking mechanism capable of quickly stopping the cable from paying out upon sensing a predetermined condition when the arbor is immobilized, and (v) a passive distance limiting mechanism having a power spring capable of being wound, wherein the power spring has an interior end and exterior end with the interior end being attached to the arbor and the exterior end secured to the reel, and wherein said passive distance limiting mechanism functions independently of the active braking mechanism and is capable of prelimiting the amount of cable pay out when the arbor is mobilized;

rendering the arbor immobile to allow the active braking mechanism to function;

attaching the housing to a fixed stationary point on a building having a roof and a roof edge or a building ledge;

attaching the end of the cable that is outside the housing to a worker's garment when the worker is about to go out on a building roof or building ledge;

temporarily mobilizing the arbor;

winding the power spring a set number of turns to pretension the power spring to limit the cable length outside the housing the distance to be no greater than the distance from the housing aperture to the building roof edge or building ledge; and immobilizing the arbor so that the active braking mechanism is engaged, wherein the passive distance limiting mechanism further includes a pair of aligned plates capable of being disengaged to mobilize the arbor m order to rotate and wind the power spring, wherein one of the aligned plates is secured to the housing and the other plate is securable to a portion of the arbor such that when the plates are engaged the arbor is prohibited from movement; and an actuator that is connected to the arbor and can temporarily mobilize the arbor when the actuator is activated and applies a tensioning force to disengage the aligned plates.

25. The method according to claim 24 wherein the actuator is a cammed quick release lever and handle assembly where the handle is accessible outside the housing; and wherein the handle is turned a desired number of turns in order to wind the power spring to take up the desired portion of cable length from being paid out.

* * * * *

UNITED STATES PATENT AND TRADEMARK OFFICE

CERTIFICATE OF CORRECTION

PATENT NO. : 8,701,833 B2
APPLICATION NO. : 12/148883
DATED : April 22, 2014
INVENTOR(S) : Marquardt et al.

It is certified that error appears in the above-identified patent and that said Letters Patent is hereby corrected as shown below:

In the Specification

| | |
|---|---|
| Column 2, line 6 | "payout" should read --pay out-- |
| Column 3, line 2 | "payout" should read --pay out-- |
| Column 3, line 5 | after "relative" insert therefor --to-- |
| Column 3, line 8 | after "fittings" insert therefor --are included-- |
| Column 3, line 13 | after "as" insert therefor --a-- |
| Column 3, line 15 | "head nut" should read --nut head-- |
| Column 4, line 27 | after "by" insert therefor --a-- |
| Column 4, line 42 | after "that" insert therefor --the-- |
| Column 6, line 22 | "payout" should read --pay out-- |
| Column 6, line 24 | after "because" insert therefor --of-- |
| Column 7, line 2 | after "splines" insert therefor --/-- |
| Column 7, line 8 | "are" should read --is-- |
| Column 7, line 20 | after "30" insert therefor --(-- and after "with" delete "(" |
| Column 7, line 25 | "includes" should read --precludes-- and after "turning" insert therefor --the power spring-- |
| Column 7, line 51 | before "be" insert therefor --to-- |
| Column 8, line 7 | "payout" should read --pay out-- and after "pay out" insert therefor --to-- |

Signed and Sealed this
Fifteenth Day of July, 2014

Michelle K. Lee

Michelle K. Lee
*Deputy Director of the United States Patent and Trademark Office*

In the Claims

| | |
|---|---|
| Column 9, line 3 (Claim 3, line 1) | after “claim” insert therefor --1-- and before “wherein” delete “a” |
| Column 9, line 37 (Claim 15, line 5) | “:” should read --,-- |
| Column 9, line 43 (Claim 15, line 11) | before “capable” insert therefor --is-- |
| Column 10, line 42 (Claim 22, line 30) | “m” should read --in-- |
| Column 10, line 57 (Claim 24, line 2) | “;” should read --,-- |
| Column 10, line 62 (Claim 24, line 7) | “of” should read --a-- |
| Column 12, line 7 (Claim 24, line 39) | “m” should read --in-- |